US009136658B2

(12) United States Patent
Chang et al.

(10) Patent No.: US 9,136,658 B2
(45) Date of Patent: Sep. 15, 2015

(54) CABLE CONNECTOR WITH SWITCHING STRUCTURE

(71) Applicants: Wei Chang, Taipei (TW); Chien-Yi Yu, New Taipei (TW)

(72) Inventors: Wei Chang, Taipei (TW); Chien-Yi Yu, New Taipei (TW)

(73) Assignee: T-Conn Precision Corporation, Taipei (TW)

( * ) Notice: Subject to any disclaimer, the term of this patent is extended or adjusted under 35 U.S.C. 154(b) by 118 days.

(21) Appl. No.: 13/968,432

(22) Filed: Aug. 16, 2013

(65) Prior Publication Data

US 2015/0050827 A1 Feb. 19, 2015

(51) Int. Cl.

| | |
|---|---|
| ***H01R 13/642*** | (2006.01) |
| ***H01R 27/00*** | (2006.01) |
| ***H01R 13/627*** | (2006.01) |
| *H01R 13/622* | (2006.01) |
| *H01R 13/641* | (2006.01) |
| *H01R 107/00* | (2006.01) |

(52) U.S. Cl.

CPC ..... *H01R 27/00* (2013.01); *H01R 13/6275* (2013.01); *H01R 13/622* (2013.01); *H01R 13/641* (2013.01); *H01R 2107/00* (2013.01)

(58) Field of Classification Search

CPC .... H01R 9/0524; H01R 13/642; H01R 29/00; H01R 27/02

USPC ..... 439/173

See application file for complete search history.

(56) References Cited

U.S. PATENT DOCUMENTS

| | | | | | |
|---|---|---|---|---|---|
| 3,885,849 | A * | 5/1975 | Bailey et al. | ..... | 439/518 |
| 4,310,213 | A * | 1/1982 | Fetterolf, et al. | ..... | 439/320 |
| 4,736,999 | A * | 4/1988 | Marks et al. | ..... | 439/314 |
| 4,815,983 | A * | 3/1989 | Erickson et al. | ..... | 439/173 |
| 6,123,585 | A * | 9/2000 | Hussong et al. | ..... | 439/652 |
| 7,333,391 | B2 * | 2/2008 | Chamberlain et al. | ..... | 367/20 |
| 7,946,868 | B1 * | 5/2011 | Chen | ..... | 439/173 |
| 8,313,335 | B2 * | 11/2012 | Wu | ..... | 439/172 |
| 8,552,339 | B2 * | 10/2013 | Yunk et al. | ..... | 219/130.1 |
| 8,556,642 | B2 * | 10/2013 | Lai et al. | ..... | 439/172 |
| 8,579,656 | B2 * | 11/2013 | Huang | ..... | 439/518 |

* cited by examiner

*Primary Examiner* — Truc Nguyen

(57) ABSTRACT

Provided is a cable connector with a switching structure, including: a plug with a plug rubber core having a plurality of pin terminals and a rib; and a plug holder having a grip portion with ridges, a switch ring disposed around the grip portion, and a fastening nut abutting against the switch ring, wherein the plug holder is disposed around the plug, and the plug holder is coupled to sockets of different types by means of the switch ring. Therefore, the cable connector is hermetically sealed, fixed in place, prevented from loosening, easy to connect and assemble, convenient to change, repair, and disassemble, easy to operate, and for use in engaging with two different types of cable sockets.

5 Claims, 23 Drawing Sheets

CABLE CONNECTOR WITH SWITCHING STRUCTURE

BACKGROUND OF THE INVENTION

1. Technical Field

The present invention relates to cable connectors each with a switching structure, and more particularly, to a cable connector equipped with a switching structure and intended for use with a power line or a signal line.

2. Description of Related Art

A conventional cable connector connects a cable to any device. Due to technological advancement, plenty connectors are continually developed to enable users to perform quick connection, and increasingly great importance is attached to protection for cable connectors. In this regard, however, in the course of connecting to cables, a connector not only has to manifest basic satisfactory electrical connection characteristics, but the connector body also has to feature a specific bonding stress. However, due to various extrinsic factors, the connector is likely to get loosened after long-term use to not only cause the cables to separate from each other and thereby cause their electrical connection to fail, but also pose a safety risk. Furthermore, in attempt to fix connected cable connectors in place, the industrial sector develops different types of sockets and plugs; however, due to specification-related limitations, a type of plugs can match a single type of sockets only.

Referring to FIG. 10, not only does a conventional socket seldom meet the high-efficiency and multifunction requirements expected by a modernized industrial society, but the conventional socket is also likely to undergo material fatigue and structural wear after long-term use and thereby deteriorate its tight-fitting matching function. Hence, it is imperative to provide a cable connector which is multifunctional, easy to operate, easy to repair, and highly efficient. Referring to FIG. 11, U.S. Pat. No. 7,727,021B2 discloses connector having a plug, a socket, and a tubular shield member with an elastic arm, wherein the connector comprises a plug 10. The plug 10 comprises a plug main body 11, a plurality of pin terminals 20, a plug holder 40, a coil spring 49, a slip-out preventing member 45, a socket 60 which comprises a socket main body 61, a plurality of socket terminals 70, and a socket holder 90. The plug 10 can be either inserted into a socket free of a caulking portion or coupled to the socket 60. To connect the plug 10 to a socket free of a caulking portion, it is necessary that the external threads of the plug 10 mesh with the internal threads of the socket free of a caulking portion. To connect the plug 10 to the socket 60, it is necessary to insert an engagement nail 47 of the slip-out preventing member 45 of the plug holder 40 of the plug 10 into a caulking portion 84 and a recessed portion 83 in the inner cavity of the socket holder 90, compress the coil spring 49, and couple the plug holder 40 and the socket holder 90 together firmly under a resilient thrust exerted by the coil spring 49. The pin terminals 20 of the plug main body 11 are electrically connected to the socket terminals 70 of the socket main body 61. Hence, a connector applicable to two types of sockets is attained. However, the cable connector comprises a coil spring which functions as a switching and snap-engaging structure. After long use, the coil spring undergoes resilience failure or displacement and thus results in deterioration of coupling stress, thereby losing the switching and snap-engaging function. Furthermore, after the connector has got loosened, power transmission interruption is likely to occur, thereby posing a safety risk. Moreover, the coil spring is disposed in an inner cavity of the plug and thus renders it inconvenient to assemble, install, disassemble, and repair the cable connector, thereby failing to meet the requirements of convenience and high efficiency.

Accordingly, it is imperative to provide a cable connector with a switching structure such that the cable connector is hermetically sealed, fixed in place, prevented from loosening, easy to connect and assemble, convenient to change, repair, and disassemble, easy to operate, and for use in engaging with two different types of M12 sockets.

SUMMARY OF THE INVENTION

It is an objective of the present invention to provide a cable connector with a switching structure such that the cable connector is hermetically sealed, fixed in place, prevented from loosening, easy to connect and assemble, convenient to change, repair, and disassemble, easy to operate, and for use in engaging with two different types of M12 sockets.

In order to achieve the above and other objectives, the present invention provides a cable connector with a switching structure, comprising: a plug with a plug rubber core having a plurality of pin terminals and a rib; and a plug holder having a grip portion with ridges, a switch ring disposed around the grip portion, and a fastening nut abutting against the switch ring, wherein the plug holder is disposed around a surface of the plug, and the plug holder is coupled to socket holders of different types by means of the switch ring.

In the first embodiment of the present invention, the switch ring disposed around the grip portion of the plug holder is annular and has at least a leaf spring, a lever, and a ring which are formed integrally as a unitary structure.

In the first embodiment of the present invention, a front end of the at least a leaf spring of the switch ring has a bump.

In the first embodiment of the present invention, a rear end of the lever of the switch ring has a bend portion.

In the first embodiment of the present invention, the at least a leaf spring of the switch ring is disposed on an outer circumferential side of the ring.

In the first embodiment of the present invention, a nut circumferential portion of the fastening nut has at least a first engaging block.

In the first embodiment of the present invention, an outer circumferential surface of the fastening nut has a protuberance.

In the first embodiment of the present invention, a first slot is disposed on an upper surface of the grip portion of the plug holder and adapted to receive a lever, and a front end of the grip portion of the plug holder has at least a second slot for receiving at least a leaf spring of the switch ring, the at least a second slot extending from the front end of the grip portion to a screw portion of the plug holder to thereby couple together the at least a leaf spring, the lever, a ring, and the plug holder, and at least a second engaging block disposed on an inner wall of the plug holder and engaged with at least a first engaging block.

In the first embodiment of the present invention, a protuberance is disposed at the at least a second slot of the plug holder.

In the first embodiment of the present invention, at least a guide block is disposed on a surface of the plug holder and comes in form of a convex block or a concave block.

In the second embodiment of the present invention, the at least a leaf spring of the switch ring is disposed on an inner circumferential side of the ring.

In the third embodiment of the present invention, a cable connector with a switching structure comprises: a plug with a plug rubber core having a plurality of pin terminals and a rib; and a plug holder having a grip portion with ridges and a switching structure disposed around the grip portion, the switching structure comprising a switch ring and a fastening nut which are formed integrally as a unitary structure, wherein the plug holder is disposed around a surface of the plug, and the plug holder is coupled to sockets of different types by means of the switch ring.

In the fourth embodiment of the present invention, a cable connector with a switching structure comprises: a plug with a plug rubber core having a plurality of pin terminals and a rib; and a plug holder having a grip portion with ridges and a switch ring disposed around the grip portion, wherein the plug holder is disposed around a surface of the plug, and the plug holder is coupled to socket holders of different types by means of the switch ring.

BRIEF DESCRIPTION OF THE DRAWINGS

Objectives, features, and advantages of the present invention are hereunder illustrated with specific embodiments in conjunction with the accompanying drawings, in which.

DETAILED DESCRIPTION OF THE EMBODIMENTS OF THE INVENTION

Figure 1A:
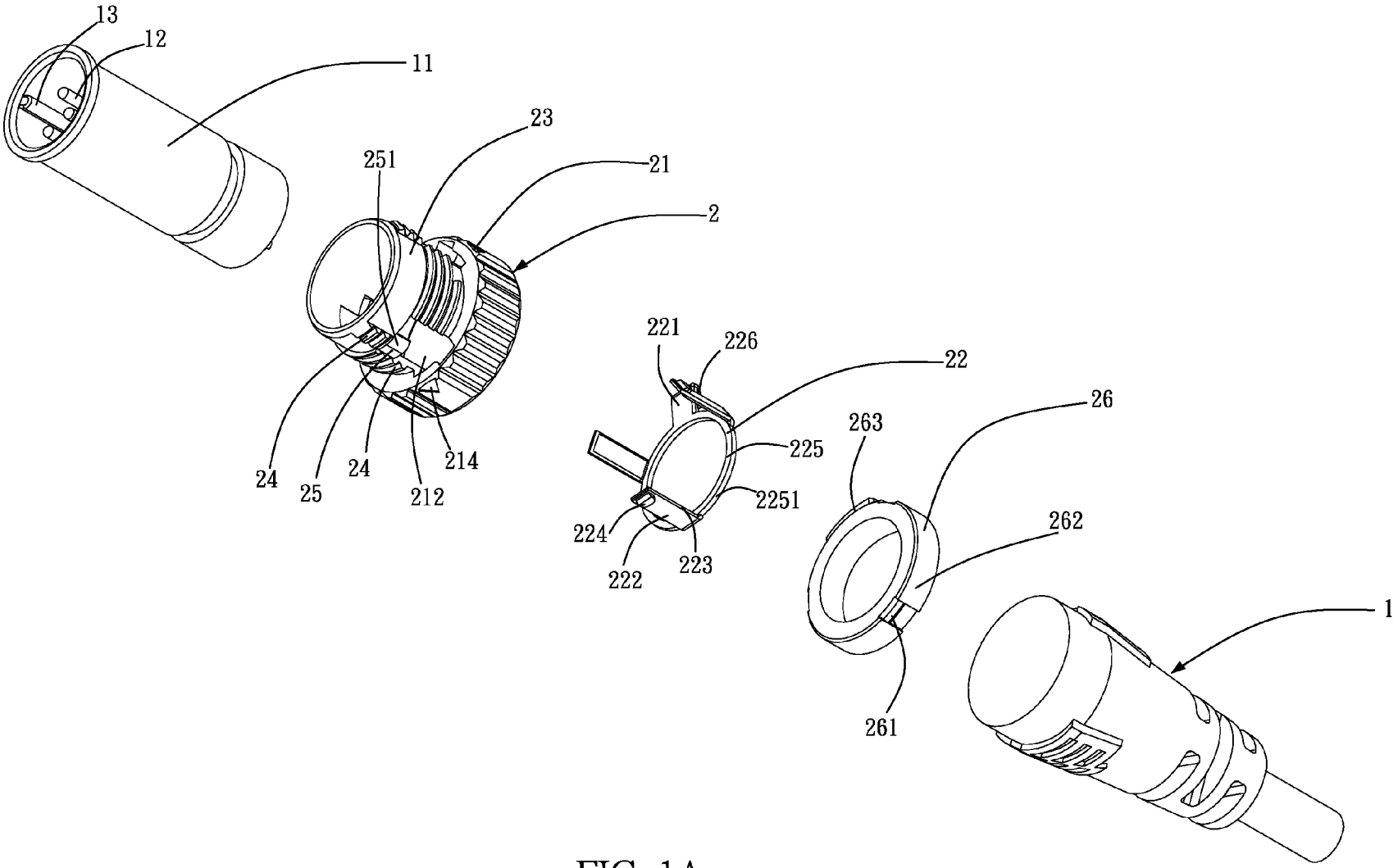
FIG. 1A is an exploded view of a cable connector with a switching structure according to the first embodiment of the present invention.
Figure 1B:
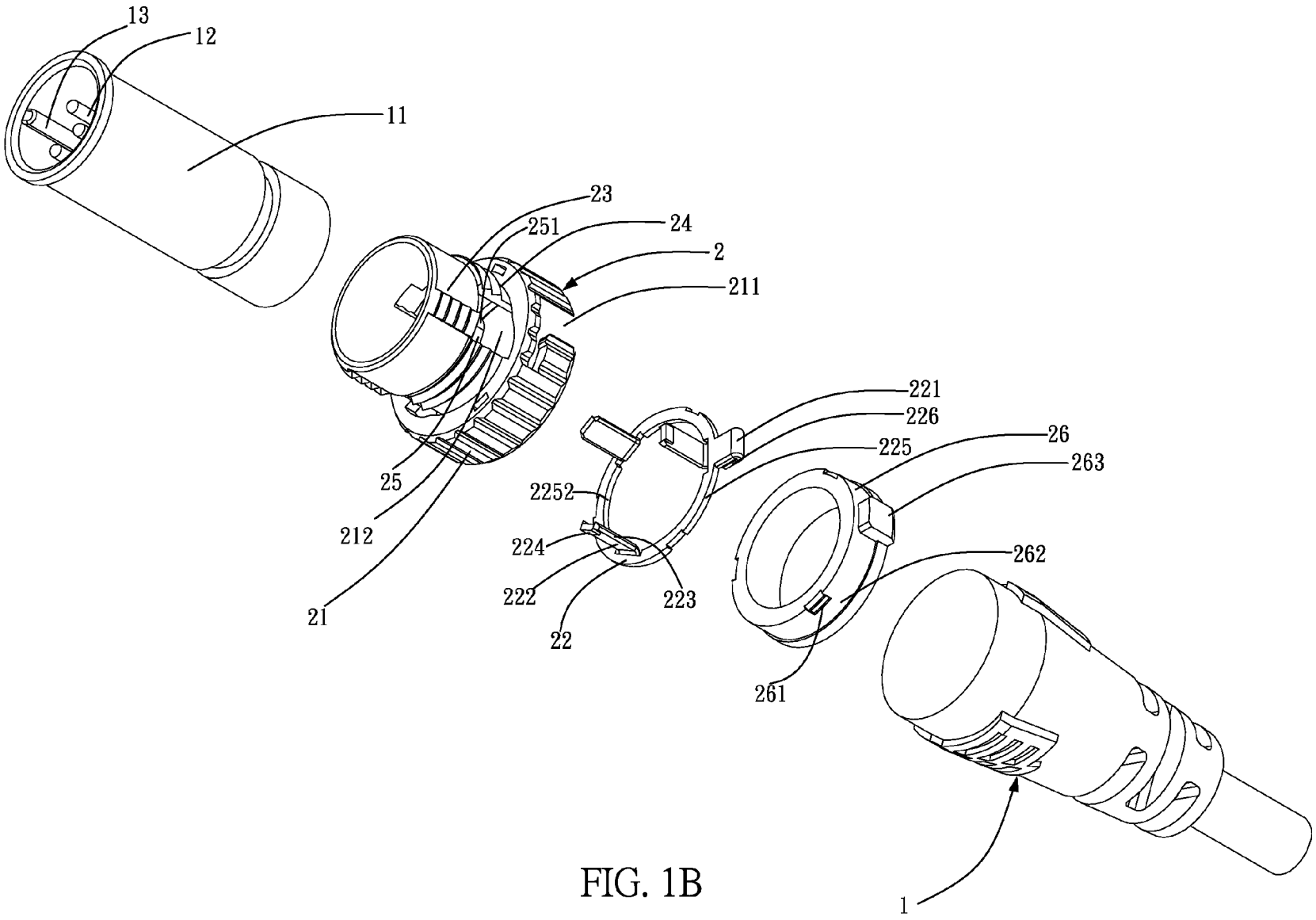
FIG. 1B is an exploded view of the cable connector with a switching structure according to the second embodiment of the present invention.
Figure 1C:
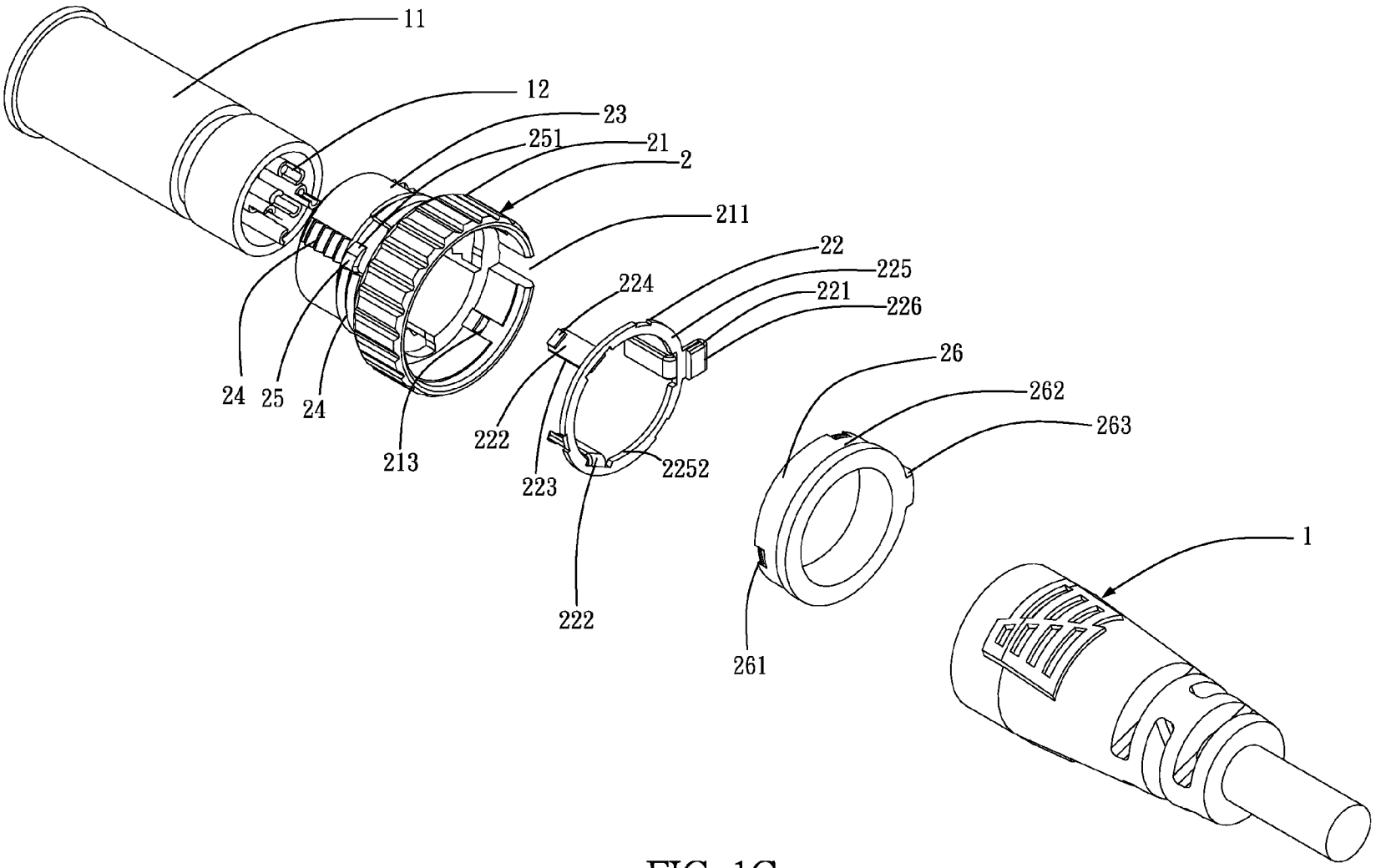
FIG. 1C is an exploded view of the cable connector viewed from another angle according to the second embodiment of the present invention.
Figure 2A:
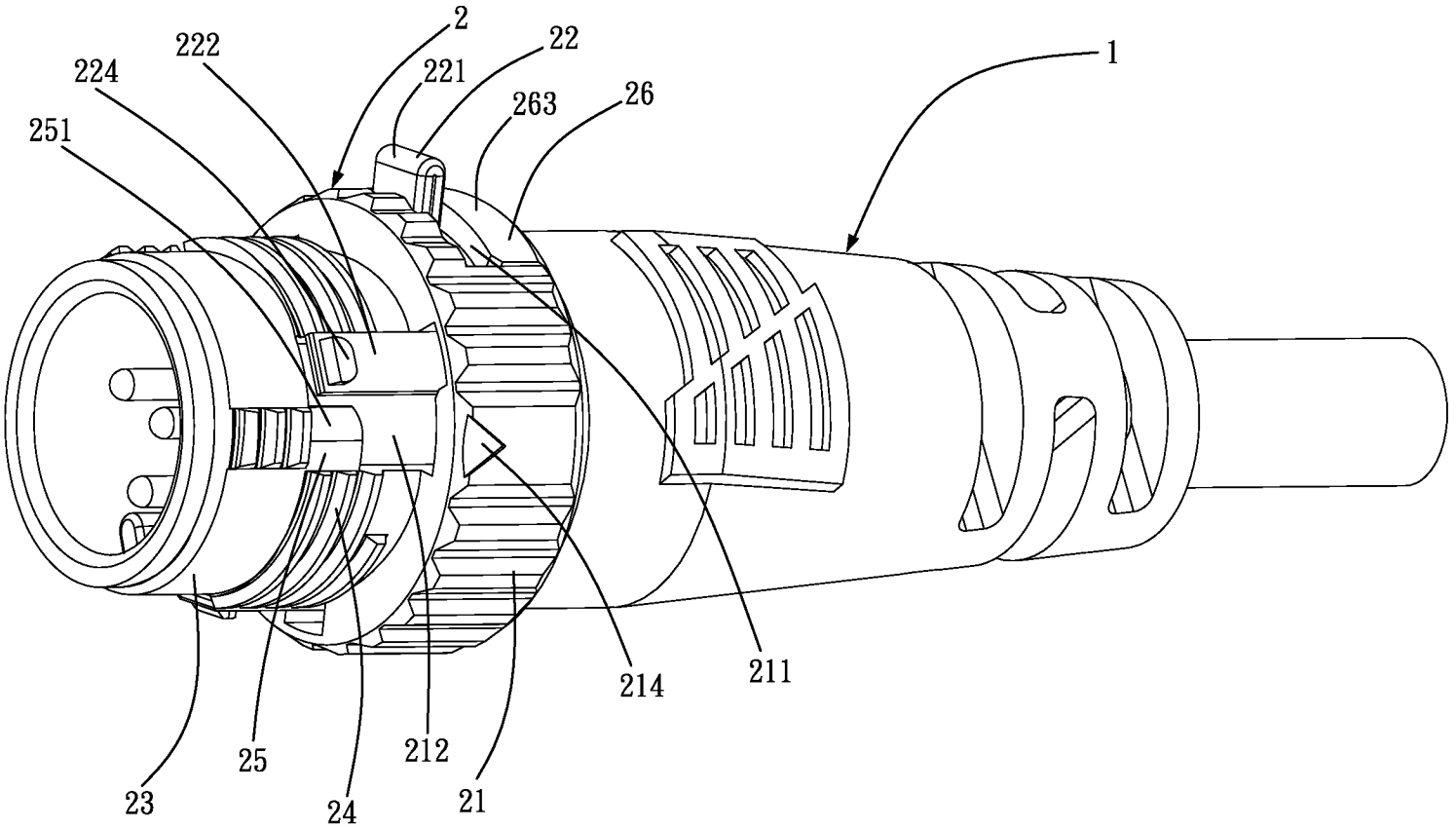
FIG. 2A is a perspective view of the cable connector with a lever in a leftward position according to the first embodiment of the present invention.
Figure 2B:
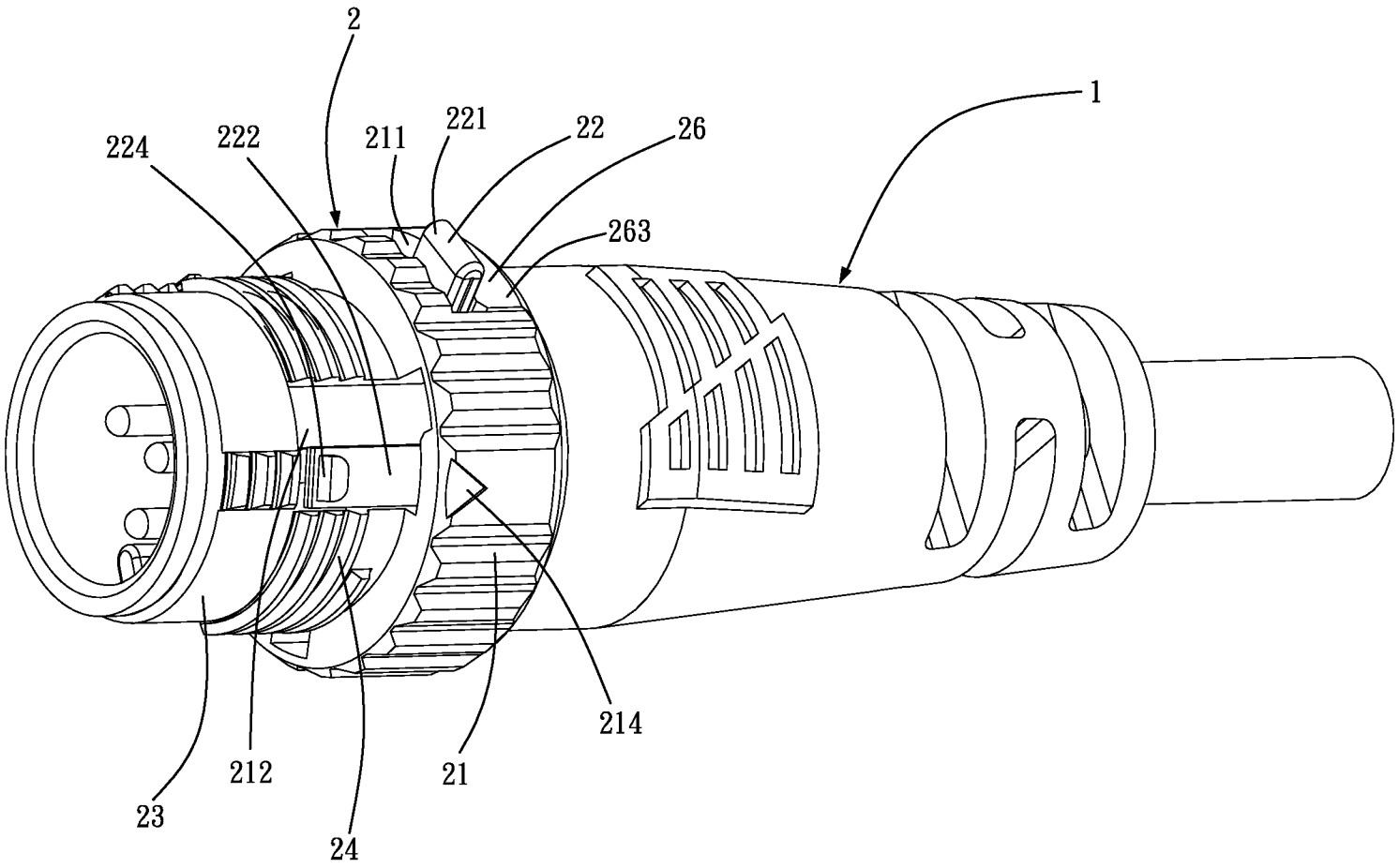
FIG. 2B is a perspective view of the cable connector with the lever in a rightward position according to the first embodiment of the present invention.
Figure 2C:
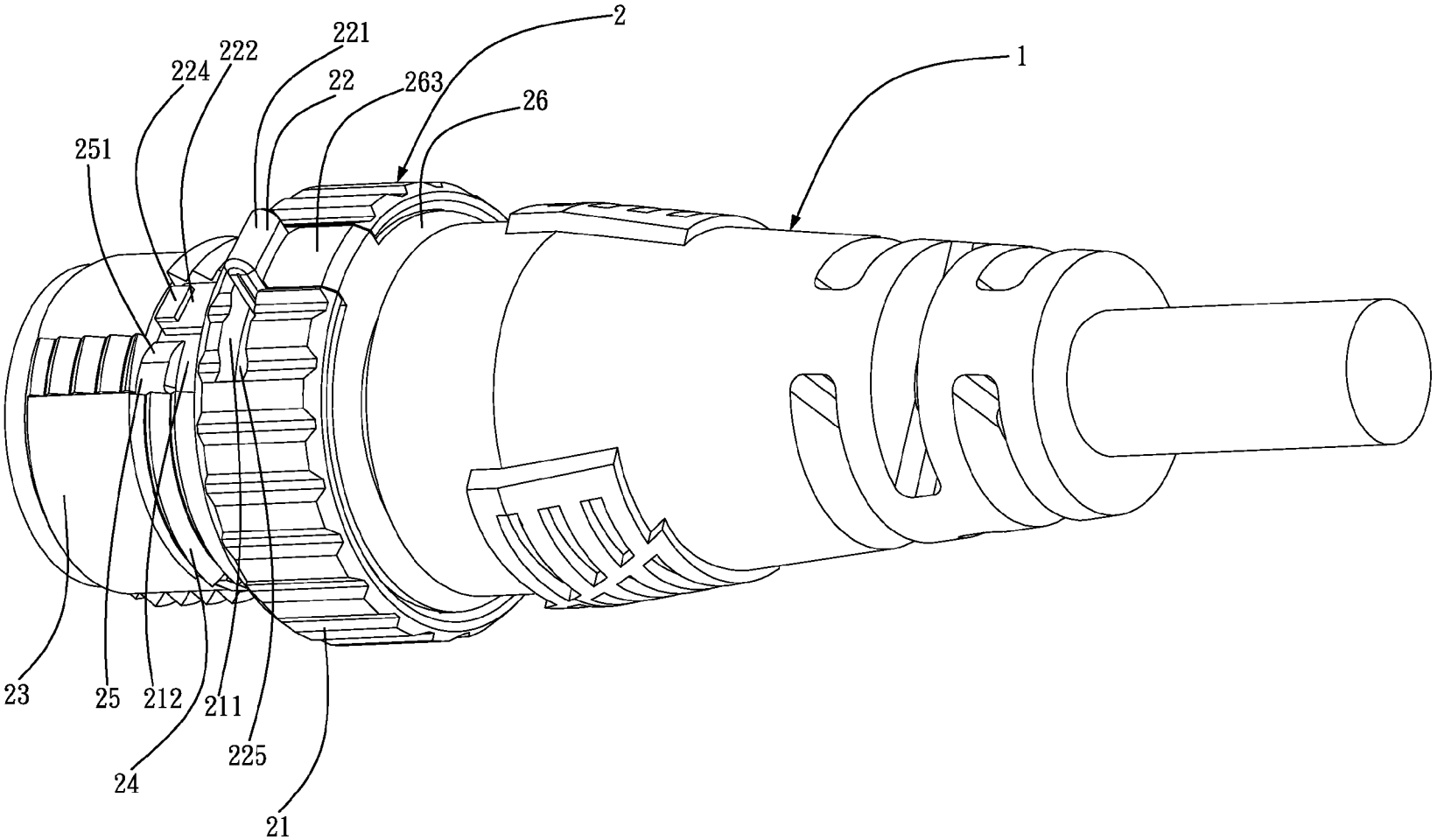
FIG. 2C is a perspective view of the cable connector with the lever in a leftward position according to the second embodiment of the present invention.
Figure 2D:
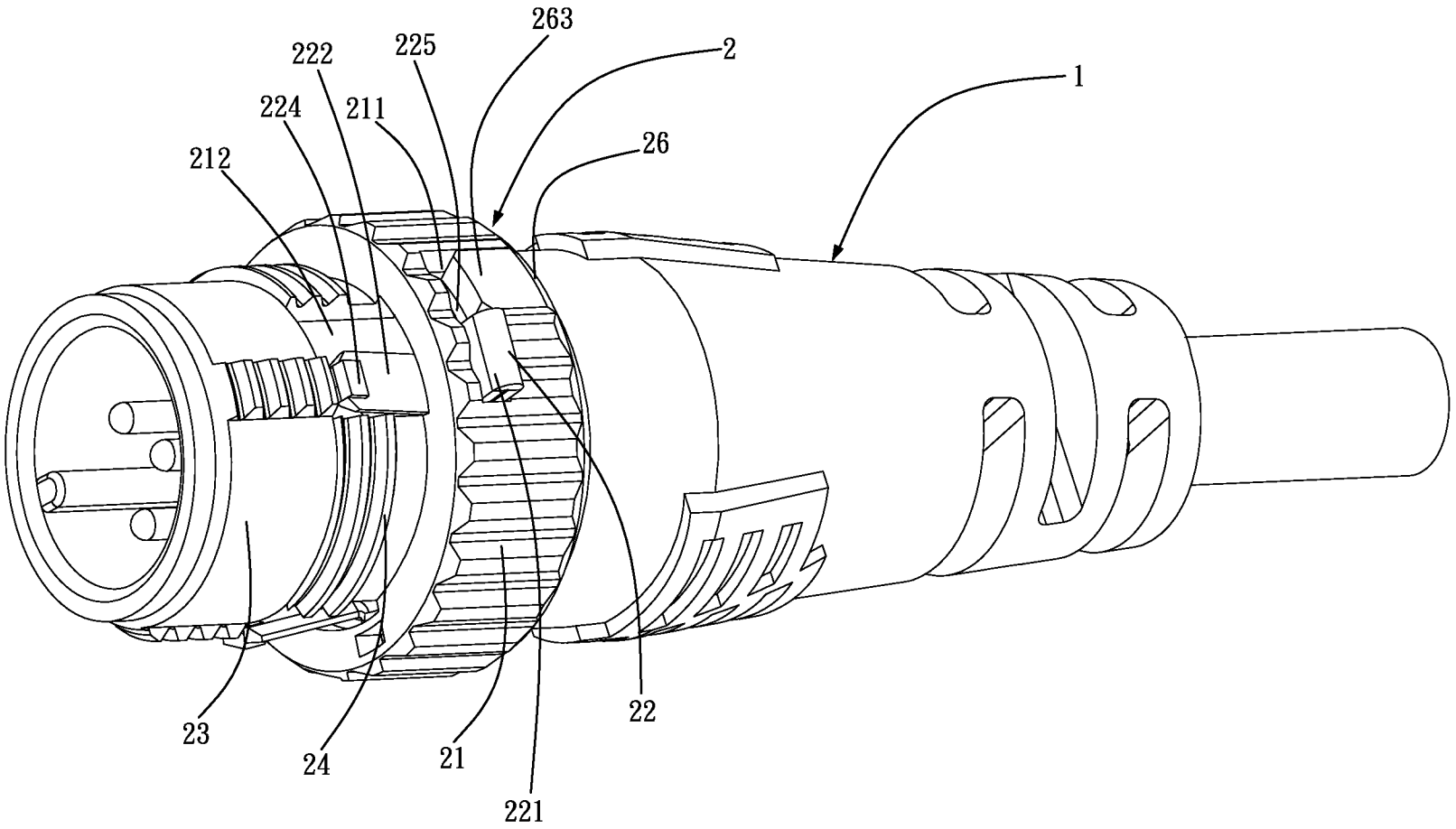
FIG. 2D is a perspective view of the cable connector with the lever in a rightward position according to the second embodiment of the present invention.

Referring to FIGS. 1A, 1B, 1C, there are shown exploded views of a cable connector with a switching structure according to the first and second embodiments of the present invention, respectively, and an exploded view of the cable connector viewed from another angle according to the second embodiment of the present invention. Referring to FIG. 1A, in the first embodiment of the present invention, the cable connector with a switching structure comprises a plug 1, a plug holder 2, a switch ring 22, and a fastening nut 26. The plug 1 has a plug rubber core 11. The plug rubber core 11 has a plurality of pin terminals 12 and a rib 13. The plug holder 2 comprises a grip portion 21 with ridges, a screw portion 23 disposed below the grip portion 21, and a plurality of external threads 24 disposed on the surface of the screw portion 23. The grip portion 21 of the plug holder 2 has a first slot 211 (as shown in FIG. 2A). The front end of the grip portion 21 of the plug holder 2 has a second slot 212. The second slot 212 extends from the front end of the grip portion 21 of the plug holder 2 to the screw portion 23 of the plug holder 2. The second slot 212 has a protuberance 25. The protuberance 25 has a protruding side 251. The switch ring 22 is disposed around the grip portion 21 of the plug holder 2. The switch ring 22 is annular. The switch ring 22 has at least a leaf spring 222, a lever 221, and a ring 225. The leaf spring 222 is disposed on an outer circumferential side 2251 of the ring 225. The leaf spring 222, the lever 221, and the ring 225 are formed integrally as a unitary structure. The front end of the at least a leaf spring 222 has a bump 224. The lateral side of the leaf spring 222 has a lateral surface 223. The rear end of the lever 221 has a bend portion 226. The fastening nut 26 has at least a first engaging block 261 and a nut circumferential portion 262. The outer circumferential surface of the fastening nut 26 has a protuberance 263. The fastening nut 26 abuts against the rear of the switch ring 22. Referring to FIGS. 1B, 1C, in the second embodiment of the present invention, the leaf spring 222 of the switch ring 22 is disposed on an inner circumferential side 2252 of the ring 225, whereas at least a second engaging block 213 is disposed on an inner wall of the grip portion 21 of the plug holder 2. The at least a second engaging block 213 is engaged with the at least a first engaging block 261 of the fastening nut 26. The plug holder 2 is disposed around the plug 1. The plug holder 2 is coupled to socket holders 4, 6 of different types by means of the switch ring 22.

Referring to FIGS. 2A, 2B, 2C, 2D, there are shown perspective views of the cable connector with a lever in a leftward position and a rightward position according to the first embodiment of the present invention, respectively, and perspective views of the cable connector with the lever in a leftward position and a rightward position according to the second embodiment of the present invention, respectively. As shown in the diagrams, the at least a leaf spring 222 of the switch ring 22 is disposed in the second slot 212, whereas the lever 221 of the switch ring 22 is disposed in the first slot 211. The ring 225 of the switch ring 22 is disposed in an inner cavity of the plug holder 2. A fastening nut 26 is disposed at the rear of the switch ring 22 and adapted to fix the switch ring 22 to the inner cavity of the plug holder 2. The at least a first engaging block 261 of the fastening nut 26 is engaged with the at least a second engaging block 213 disposed on an inner wall of the plug holder 2 (see FIG. 1C). The protuberance 263 on the outer circumferential surface of the fastening nut 26 is disposed in the first slot 211 of the plug holder 2. The fastening nut 26 abuts against the switch ring 22 from behind to thereby completely engage therewith and fix thereto and enable the switch ring 22 to be fitted snugly within the inner cavity of the plug holder 2.

Figure 3A:
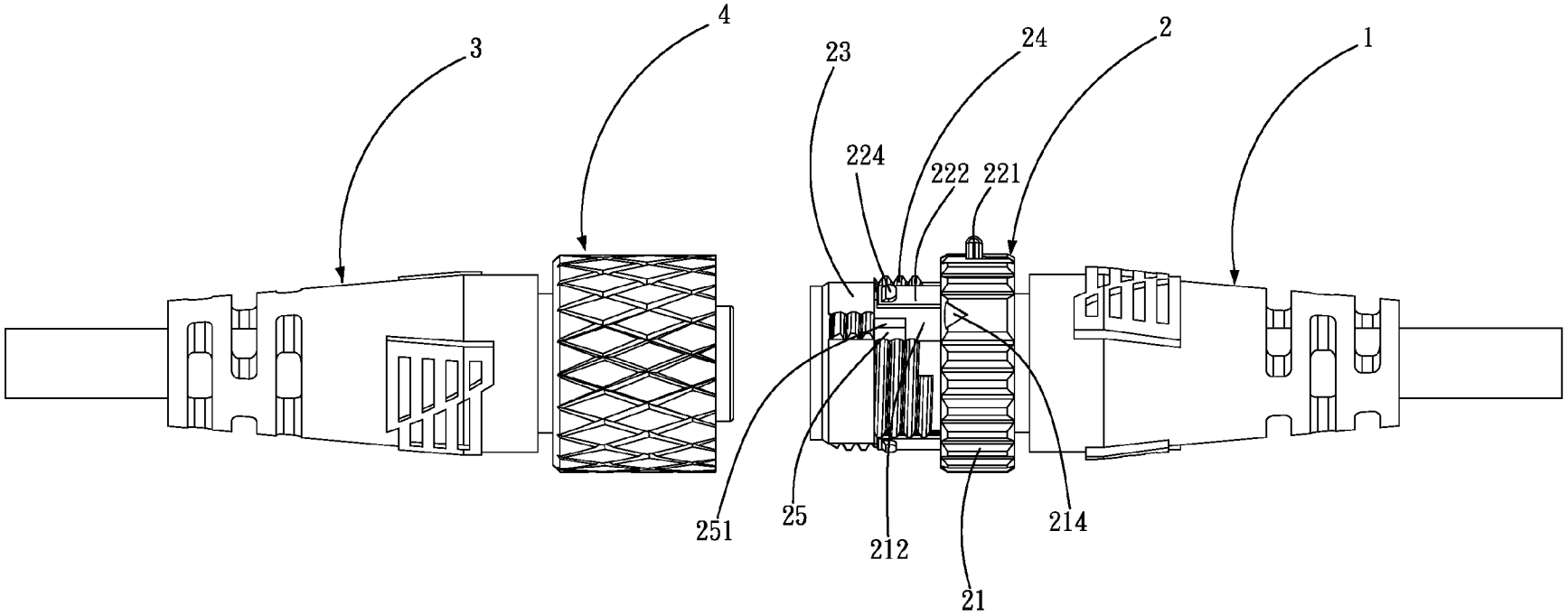
FIG. 3A is a front view which shows that the cable connector of the present invention, a conventional socket, and a caulking portion-free socket holder of the first embodiment are coupled together.
Figure 3B:
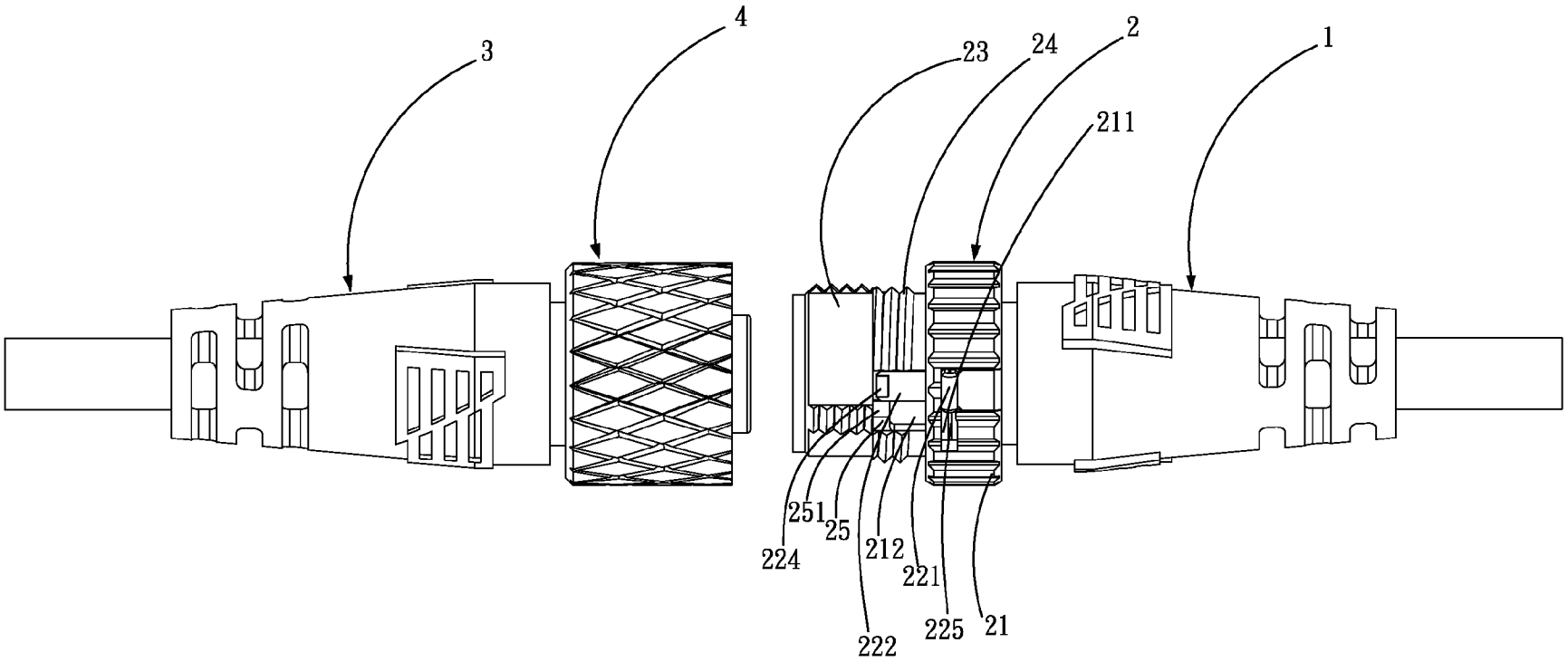
FIG. 3B is a front view which shows that the cable connector of the present invention, a conventional socket, and a caulking portion-free socket holder of the second embodiment are coupled together.

Referring to FIGS. 3A, 3B, there are shown front views which show that the cable connector of the present invention, a conventional socket, and a caulking portion-free socket holder of the first and second embodiments are coupled together, respectively. As shown in the diagrams, to allow the plug 1 and the plug holder 2 to be coupled to a conventional socket 3 and the socket holder 4 free of a caulking portion, a user may push the lever 221 in the first slot 211 leftward (viewed from the end of the socket holder 4 free of a caulking portion,) such that the lever 221 drives the at least a leaf spring 222 to move toward one side within the second slot 212, wherein the protuberance 25 is absent from the one side within the second slot 212.

Referring to FIGS. 4A, 4B, 4C, 4D, there are shown perspective views of the cable connector of the present invention, a conventional socket, and the caulking portion-free socket holder before and during an assembly process according to the first embodiment of the present invention, respectively, a cutaway view thereof after the assembly process according to the first embodiment of the present invention, and a perspective view thereof viewed from another angle after the assembly process according to the second embodiment of the present invention. As shown in the diagrams, to allow the plug 1 and the plug holder 2 to be coupled to the conventional socket 3 and the socket holder 4 free of a caulking portion, the user may push the lever 221 in the first slot 211 leftward (viewed from the end of the socket holder 4 free of a caulking portion,) such that the at least a leaf spring 222 moves to one side within the second slot 212, wherein the protuberance 25 is absent from the one side within the second slot 212. As soon as the rib 13 of plug 1 (as shown in FIG. 1A) enters a longitudinal groove 33 of the socket 3 entirely, socket terminals 32 of the socket 3 are engaged synchronously with pin terminals 12 of the plug 1 (as shown in FIG. 1A) to form electrical connection therebetween. Afterward, the user rotates the plug holder 2 to insert the plug holder 2 into the socket holder 4, thereby allowing the external threads 24 of the plug holder 2 and internal threads 41 of the socket holder 4 to mesh with each other. The at least a leaf spring 222 of the first embodiment is disposed on the outer circumferential side 2251 of the ring 225 (as shown in FIG. 1A); hence, after the external threads 24 of the plug holder 2 and the internal threads 41 of the socket holder 4 have meshed with each other, the at least a leaf spring 222 contracts under a force exerted by the internal threads 41 of the socket holder 4.

Figure 4A:
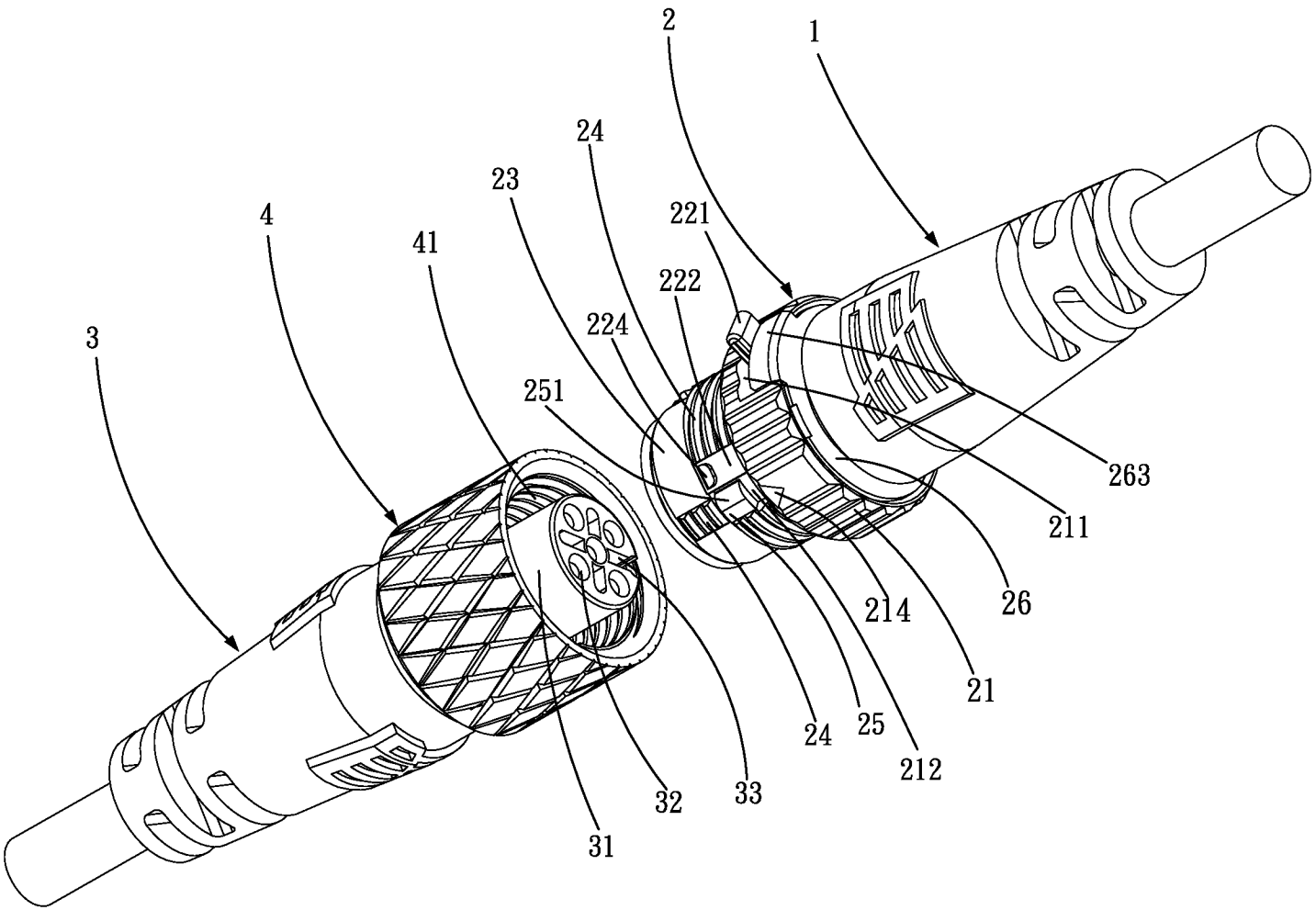
FIG. 4A is a perspective view of the cable connector of the present invention, a conventional socket, and the caulking portion-free socket holder before an assembly process according to the first embodiment of the present invention.
Figure 4B:
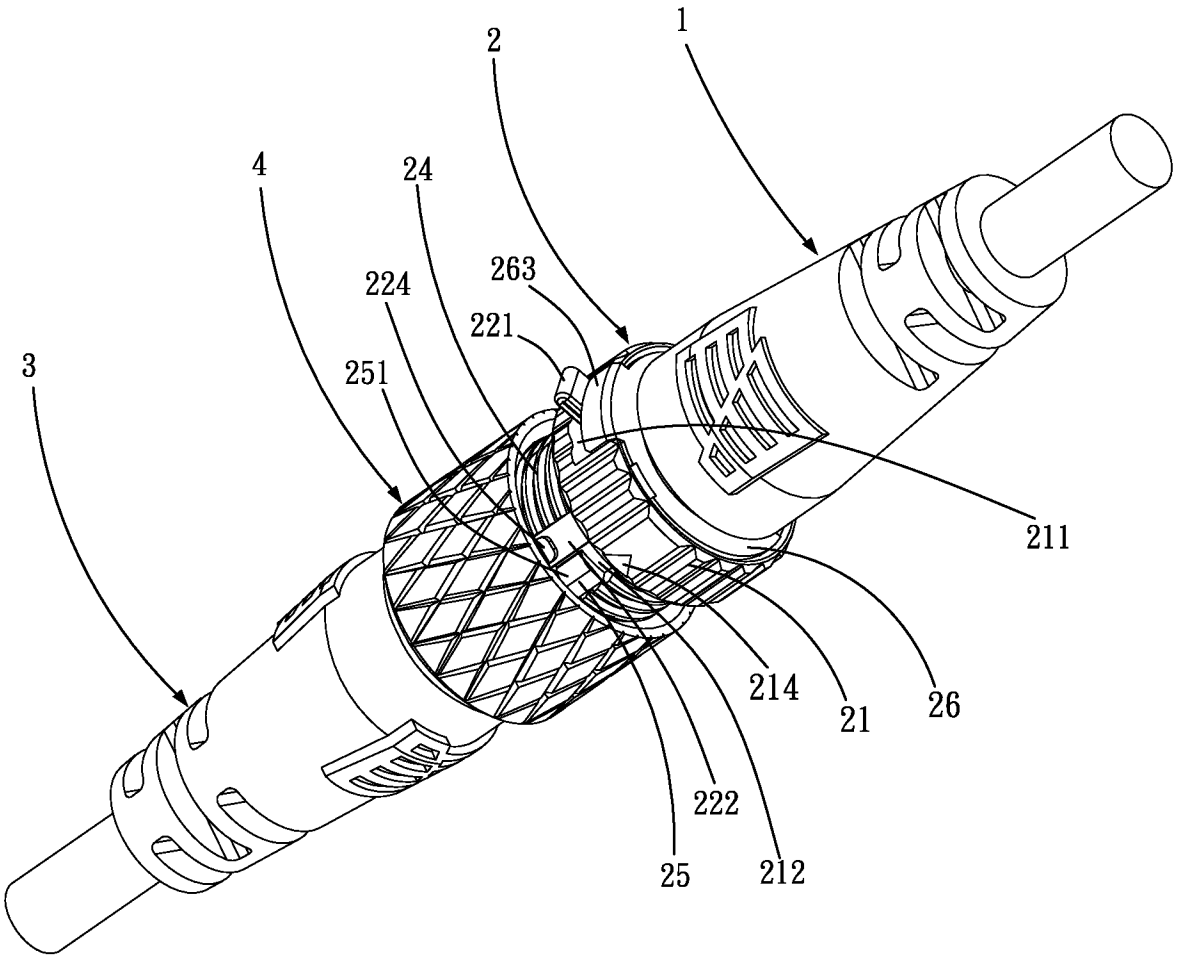
FIG. 4B is a perspective view of the cable connector of the present invention, a conventional socket, and the caulking portion-free socket holder during the assembly process according to the first embodiment of the present invention.
Figure 4C:
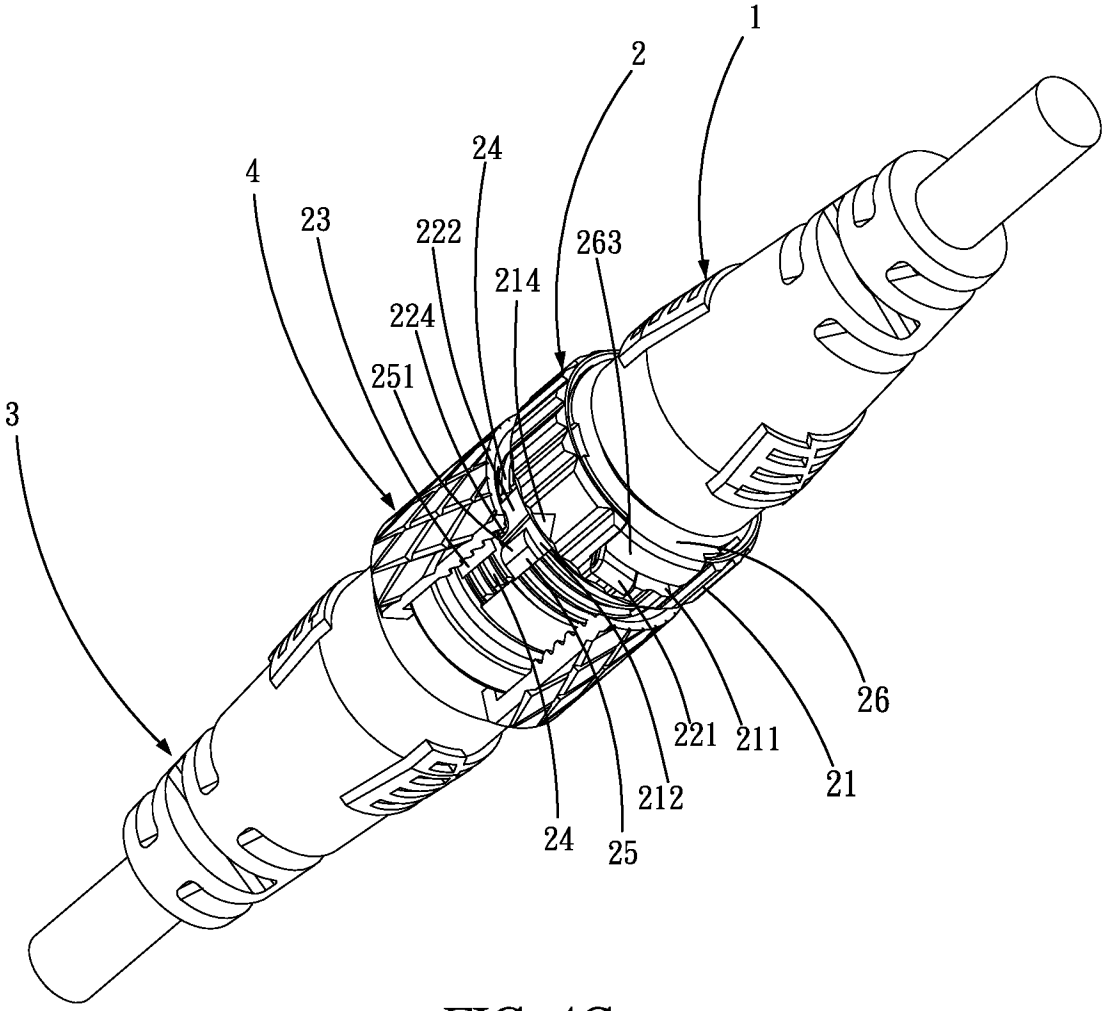
FIG. 4C is a cutaway view of the cable connector of the present invention, a conventional socket, and the caulking portion-free socket holder after the assembly process according to the first embodiment of the present invention.
Figure 4D:
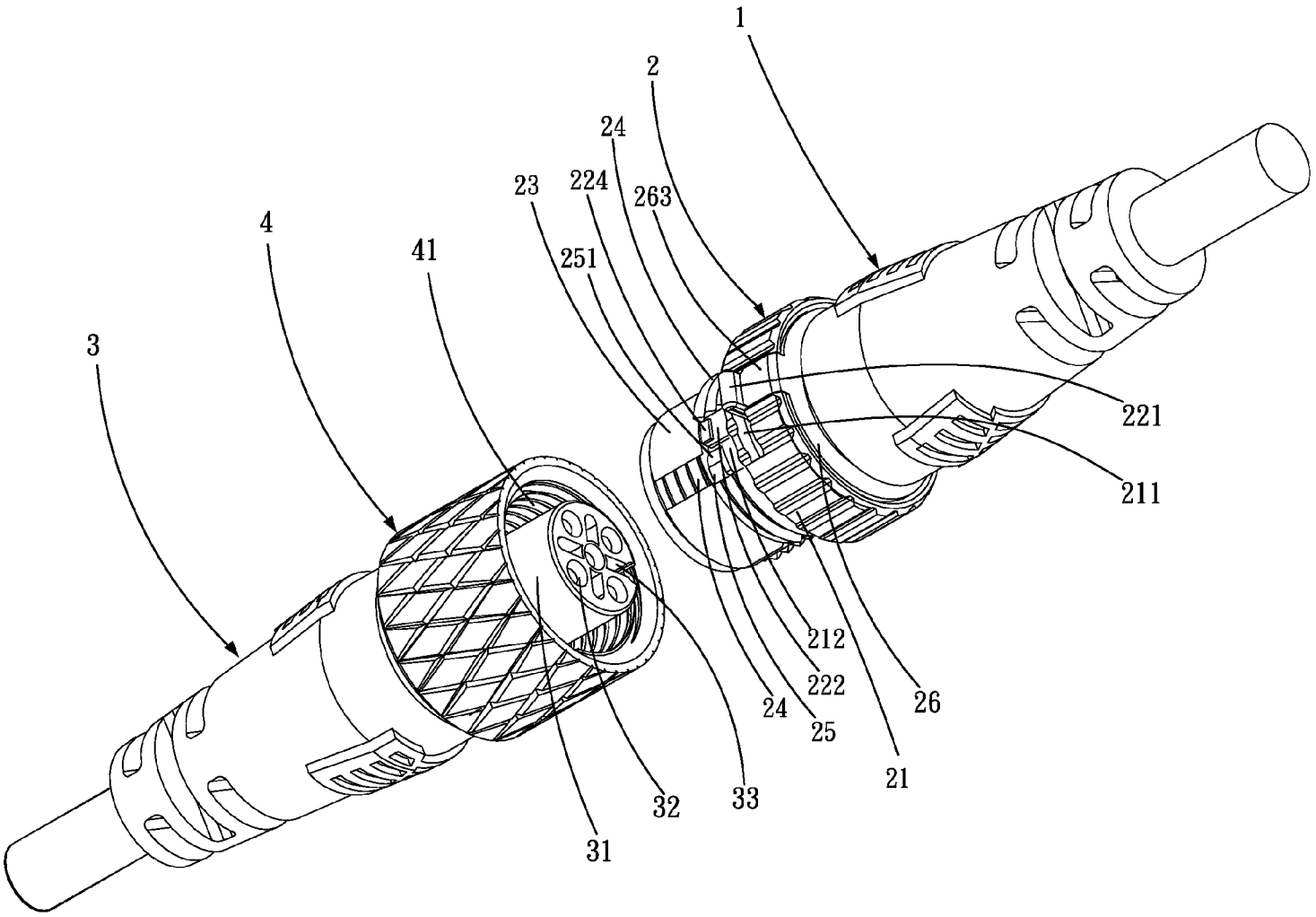
FIG. 4D is a perspective view of the cable connector of the present invention, a conventional socket, and the caulking portion-free socket holder which are viewed from another angle after the assembly process according to the second embodiment of the present invention.
Figure 5A:
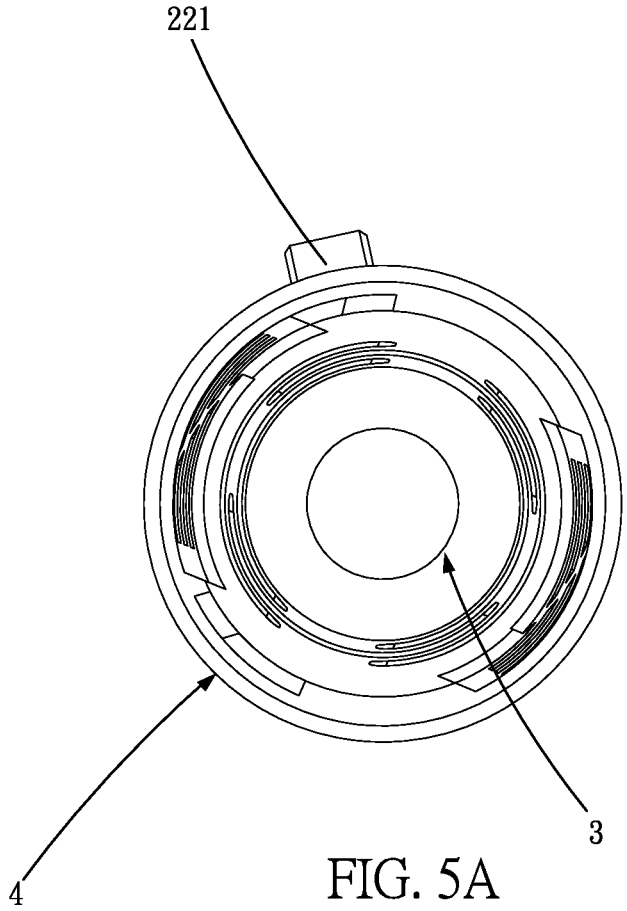
FIG. 5A is a left lateral view of the cable connector of the present invention, a conventional socket, and the caulking portion-free socket holder after the assembly process according to the first embodiment of the present invention.
Figure 5B:
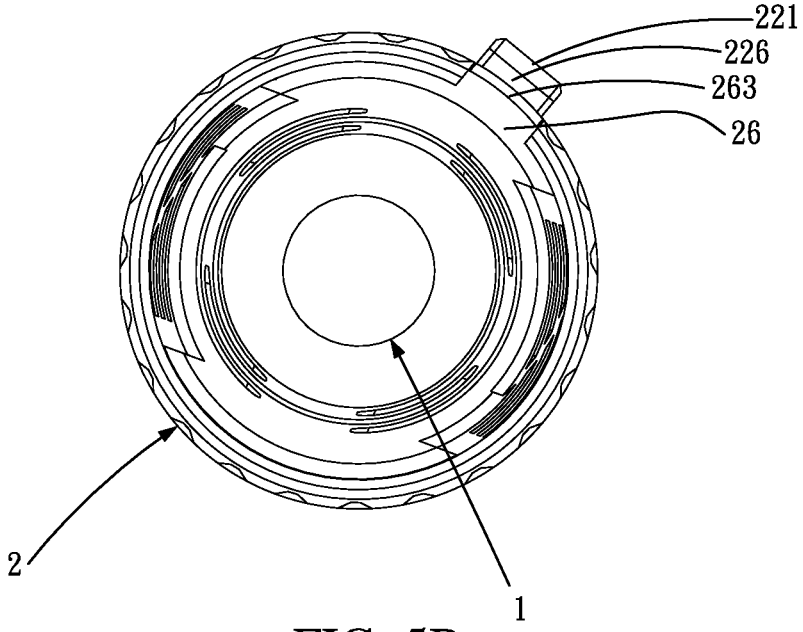
FIG. 5B is a right lateral view of the cable connector of the present invention, a conventional socket, and the caulking portion-free socket holder after the assembly process according to the first embodiment of the present invention.

Referring to FIGS. 5A, 5B, there are shown left and right lateral views of the cable connector of the present invention, a conventional socket, and the caulking portion-free socket holder after the assembly process according to the first embodiment of the present invention, respectively. As shown in the diagrams, to allow the plug 1 and the plug holder 2 to be coupled to the conventional socket 3 and the socket holder 4 free of a caulking portion, the user pushes the lever 221 leftward (viewed from the end of the socket holder 4 free of a caulking portion,) such that the at least a leaf spring 222 moves to one side within the second slot 212, wherein the protuberance 25 is absent from the one side within the second slot 212 (as shown in FIG. 4A.) The switch ring 22 is fixed to the inner cavity of the plug holder 2 by means of the fastening nut 26. The lever 221 is disposed in the first slot 211 (as shown in FIG. 2A.) The bend portion 226 at the rear end of the lever 221 abuts against the protuberance 263 of the fastening nut 26.

Figure 6A:
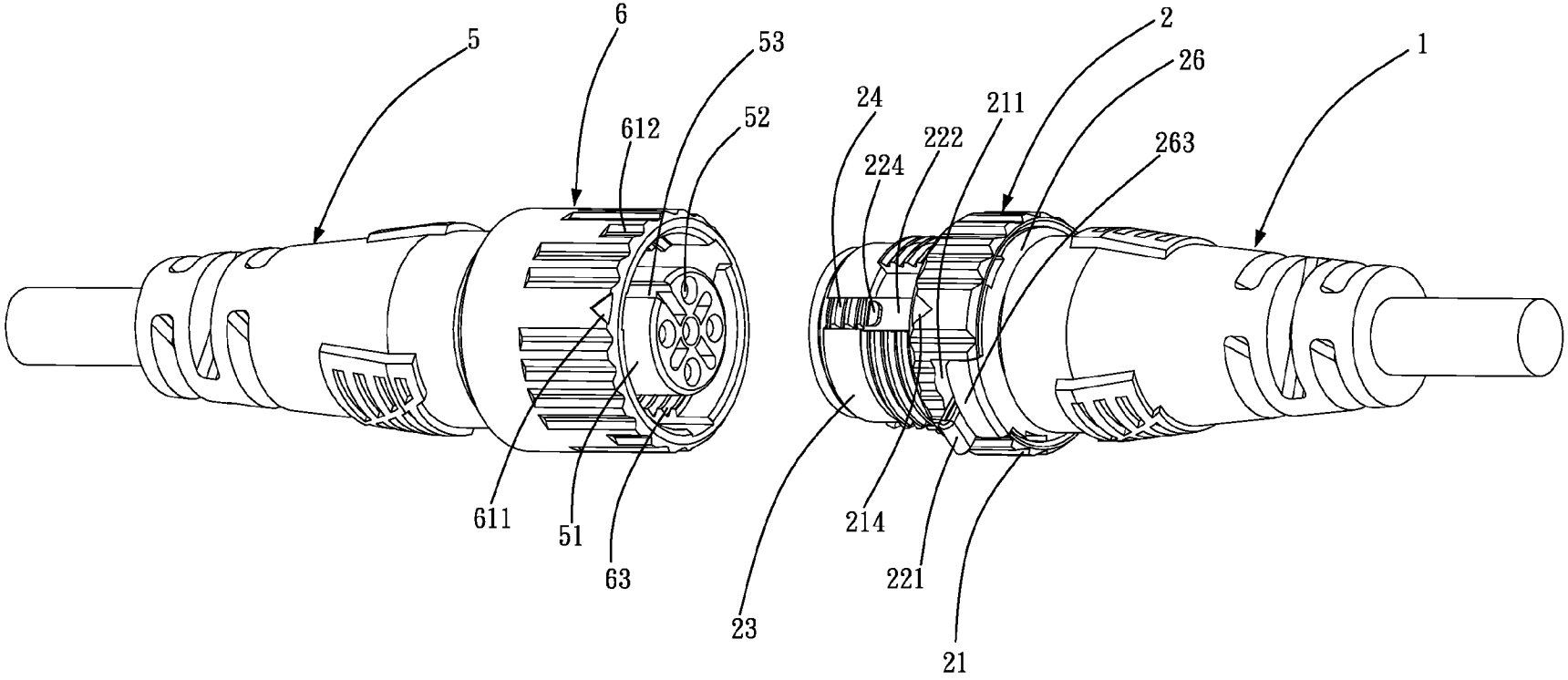
FIG. 6A is a schematic view of the cable connector of the present invention, a conventional socket, and a caulking portion-equipped socket holder before the assembly process according to the first embodiment of the present invention.
Figure 6B:
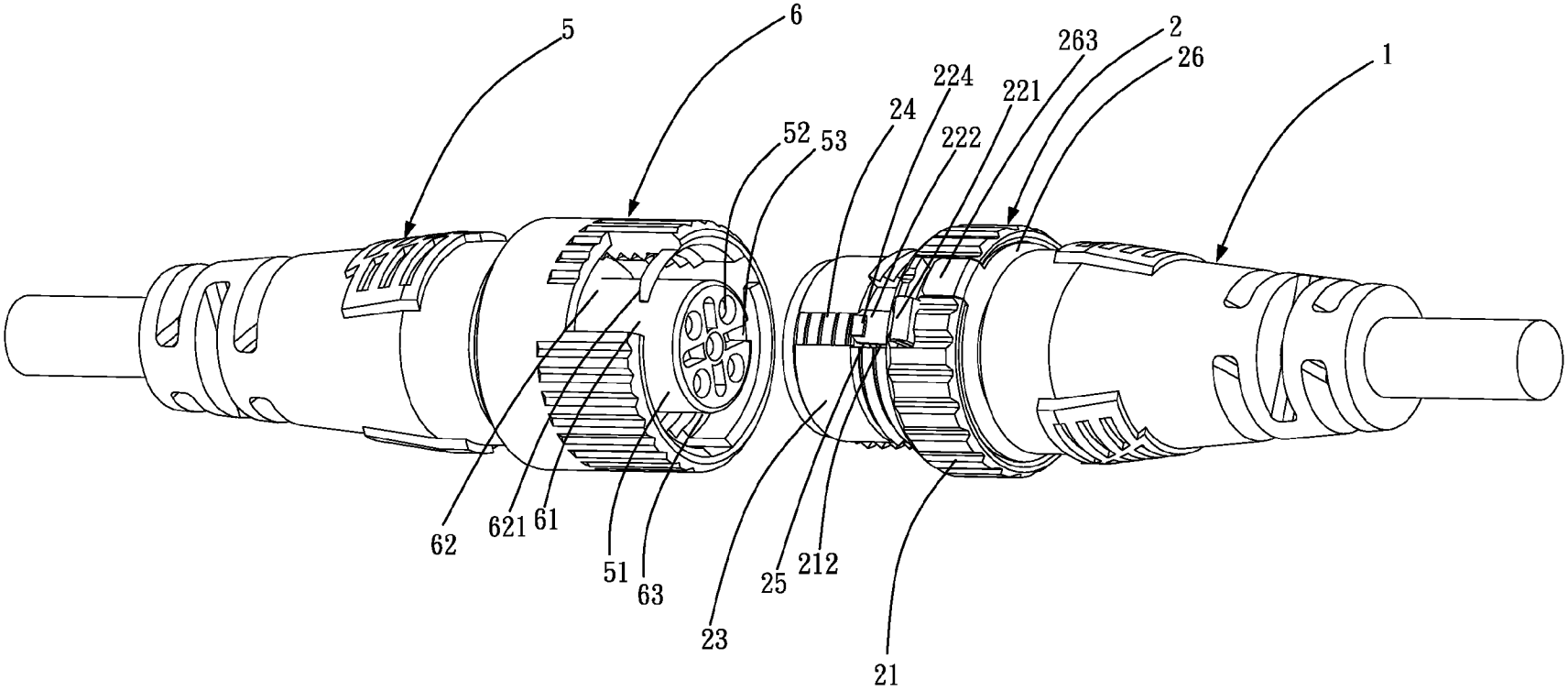
FIG. 6B is a schematic view of the cable connector of the present invention, a conventional socket, and a caulking portion-equipped socket holder before the assembly process according to the second embodiment of the present invention.

Referring to FIGS. 6A, 6B, there are shown schematic views of the cable connector of the present invention, a conventional socket, and a caulking portion-equipped socket holder before the assembly process according to the first and second embodiments of the present invention, respectively. As shown in the diagrams, a plurality of guide blocks 214 is disposed on the surface of the plug holder 2, and the guide blocks 214 are convex blocks or concave blocks. A plurality of guide blocks 611 and a plurality of fixed-point blocks 612 are disposed on the surface of the socket holder 6 equipped with a caulking portion. The guide blocks 611 and the fixed-point blocks 612 are convex blocks or concave blocks. To allow the plug 1 and the plug holder 2 to be coupled to a socket 5 and the socket holder 6 equipped with a caulking portion, the user pushes the lever 221 in the first slot 211 rightward (viewed from the end of the socket holder 6 equipped with a caulking portion,) such that the lever 221 drives the at least a leaf spring 222 to move rightward. The lateral surface 223 of the leaf spring 222 comes into contact with the protruding side 251 (as shown in FIGS. 1A, 1B) and then is guided by the protruding side 251 and positioned above the protuberance 25. The at least a leaf spring 222 of the first embodiment is disposed on the outer circumferential side 2251 of the ring 225 (as shown in FIG. 1A). The at least a leaf spring 222 of the second embodiment is disposed on the inner circumferential side 2252 of the ring 225 (as shown in FIG. 1B.) In the first embodiment, after the lever 221 has been moved rightward to the protuberance 25, the at least a leaf spring 222 which has been moved to stay above the protuberance 25 looks flat and straight between the external threads 24. In the second embodiment, the at least a leaf spring 222 which has been moved to stay above the protuberance 25 looks lifted between the external threads 24.

Figure 7A:
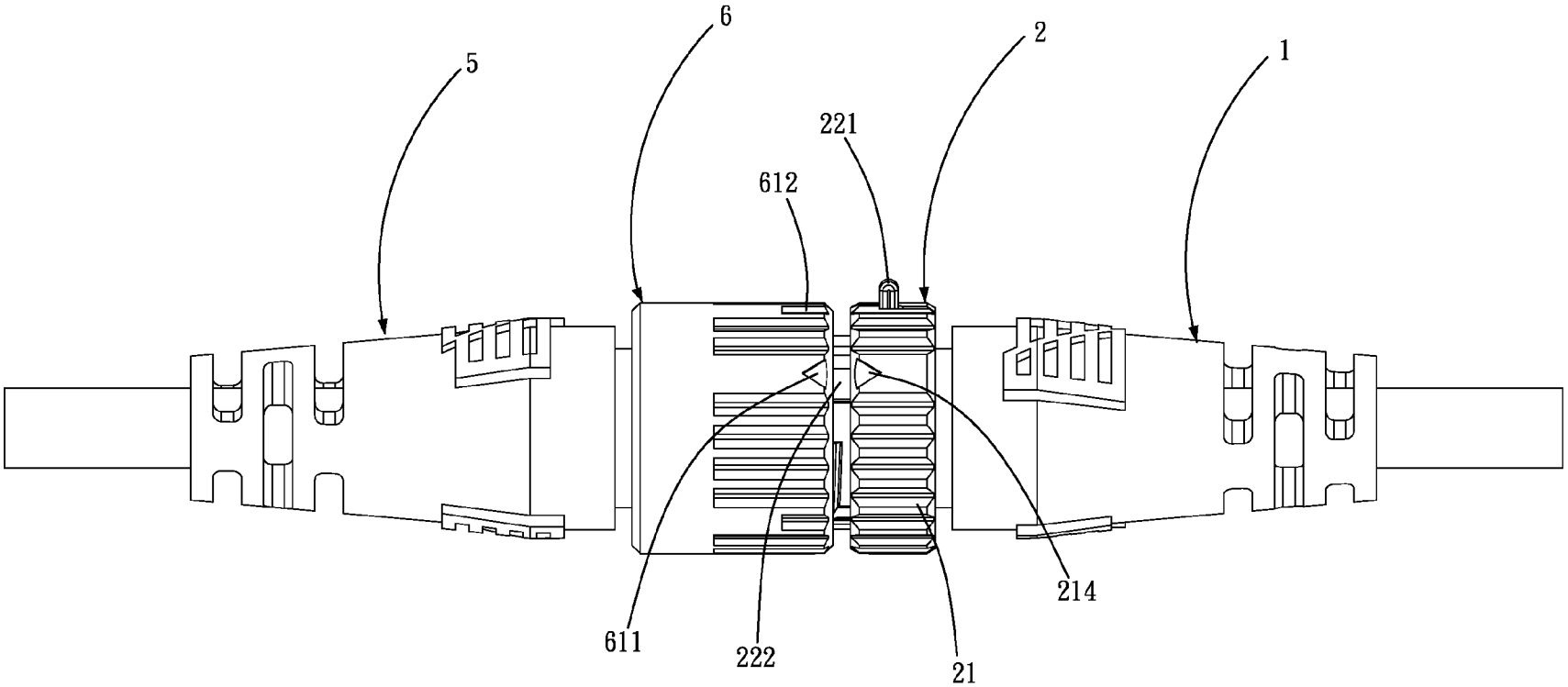
FIG. 7A is a schematic view of the cable connector of the present invention, a conventional socket, and the caulking portion-equipped socket holder during the assembly process according to the first embodiment of the present invention.
Figure 7B:
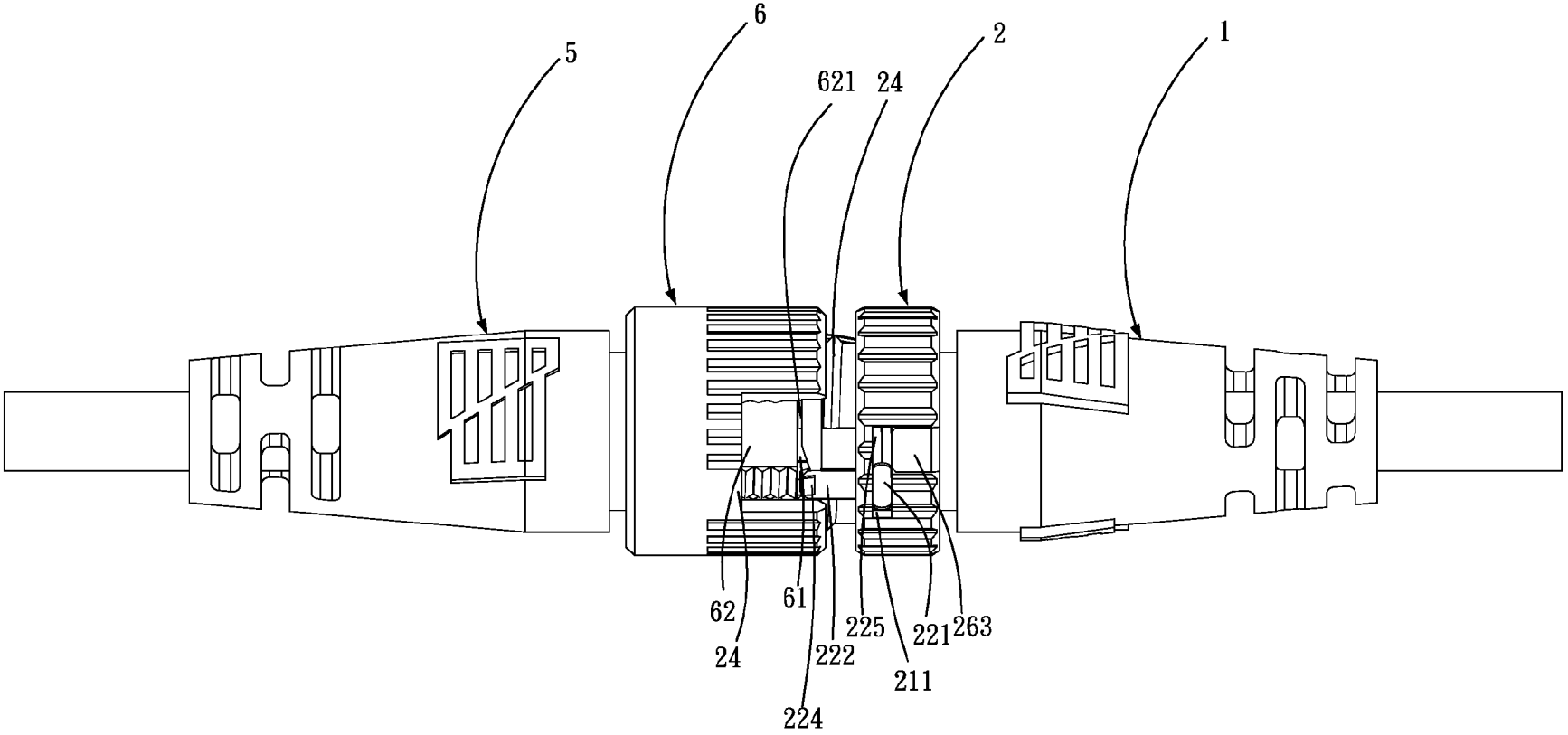
FIG. 7B is a schematic view of the cable connector of the present invention, a conventional socket, and the caulking portion-equipped socket holder during the assembly process according to the second embodiment of the present invention.

Referring to FIGS. 7A, 7B, there are shown schematic views of the cable connector of the present invention, a conventional socket, and the caulking portion-equipped socket holder during the assembly process according to the first and second embodiments of the present invention, respectively. As shown in the diagrams, the guide blocks 214 disposed on the surface of the plug holder 2 move toward the guide blocks 611 disposed on the surface of the socket holder 6 equipped with a caulking portion to engage therewith, whereas a longitudinal groove 53 of the socket 5 (see FIG. 6A) guides and engages with the rib 13 of the plug 1 (see FIG. 1A). As soon as the rib 13 of the plug 1 enters the longitudinal groove 53 of the socket 5 entirely, socket terminals 52 of the socket 5 get engaged with the pin terminals 12 of the plug 1 and thus electrically connected thereto; meanwhile, the plug holder 2 is inserted into the socket holder 6 to allow the at least a leaf spring 222 to move along the recessed portion 61 and enter the socket holder 6.

Figure 8A:
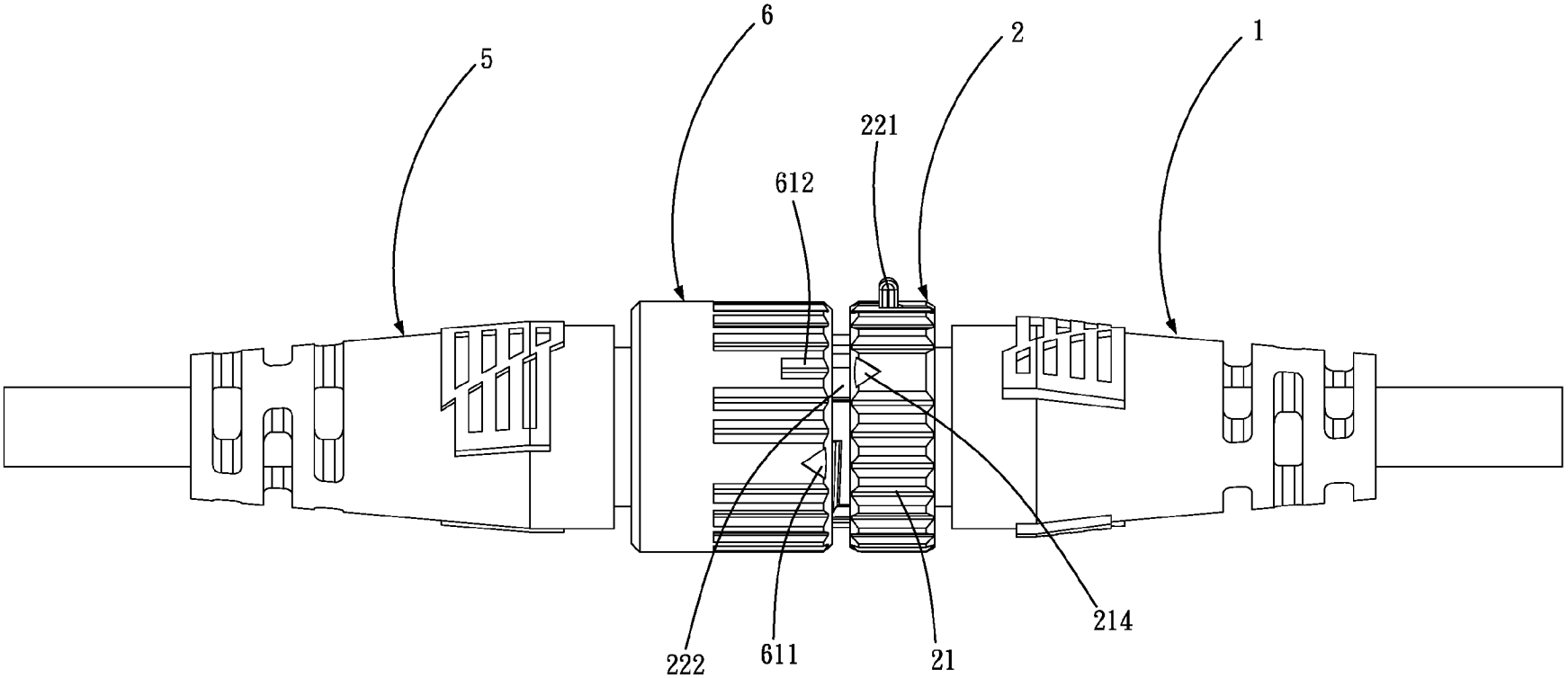
FIG. 8A is a schematic view of the cable connector of the present invention, a conventional socket, and the caulking portion-equipped socket holder after the assembly process according to the first embodiment of the present invention.
Figure 8B:
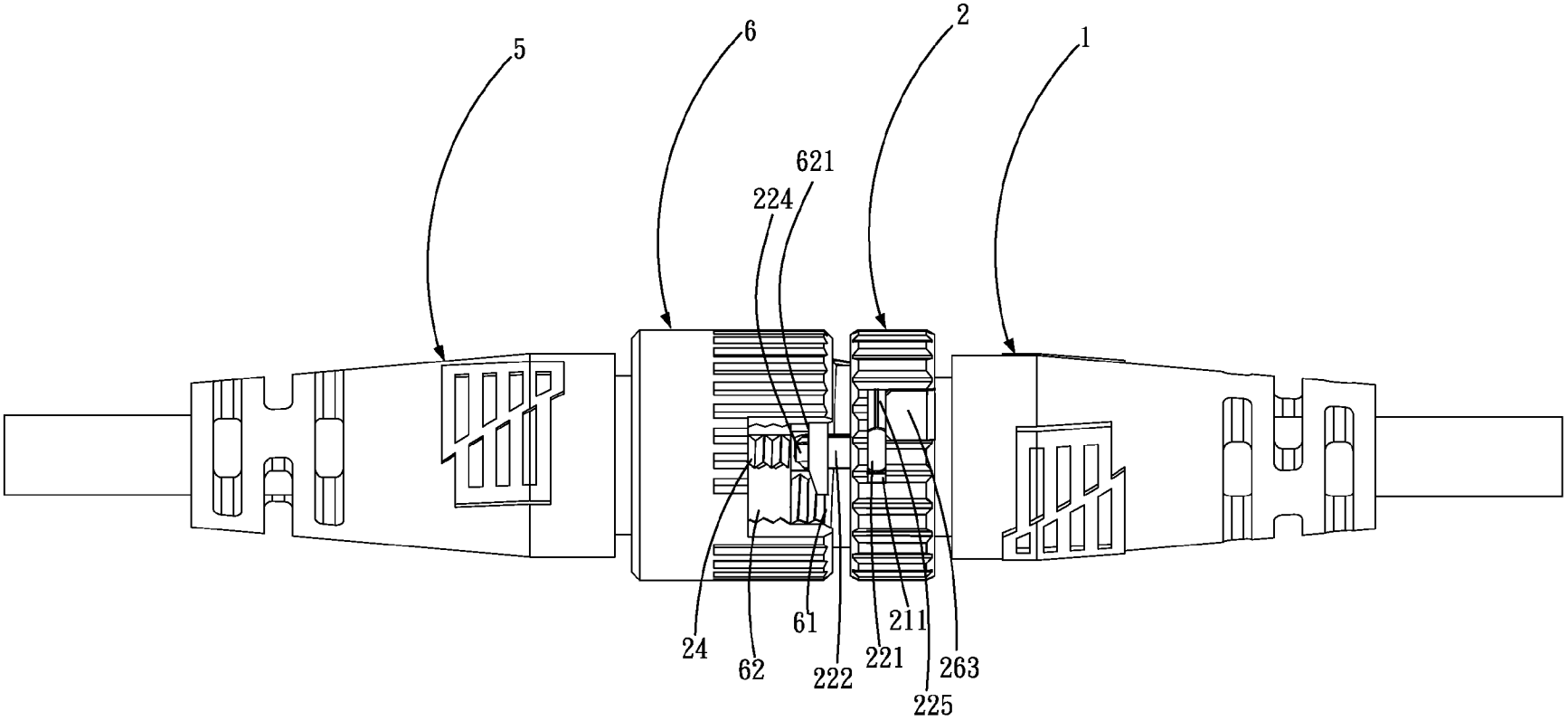
FIG. 8B is a schematic view of the cable connector of the present invention, a conventional socket, and the caulking portion-equipped socket holder after the assembly process according to the second embodiment of the present invention.

Referring to FIGS. 8A, 8B, there are shown schematic views of the cable connector of the present invention, a conventional socket, and the caulking portion-equipped socket holder after the assembly process according to the first and second embodiments of the present invention, respectively. As shown in the diagrams, the user rotates the socket holder 6 equipped with a caulking portion to thereby allow the at least a leaf spring 222 to move along a caulking portion 62, such that the guide blocks 214 which are otherwise positioned on the surface of the plug holder 2 and engaged with the guide blocks 611 are moved toward the positioning blocks 612 to engage therewith; as a result, the at least a leaf spring 222 is snap-engaged with a snap-engagement surface 621 of the caulking portion 62, and the bump 224 at the front end of the at least a leaf spring 222 abuts against the snap-engagement surface 621 of the caulking portion 62 to enhance stability. Therefore, the plug holder 2 and the socket holder 6 are snap-engaged with each other, such that the cable connector is hermetically sealed and fixed in place.

Figure 9A:
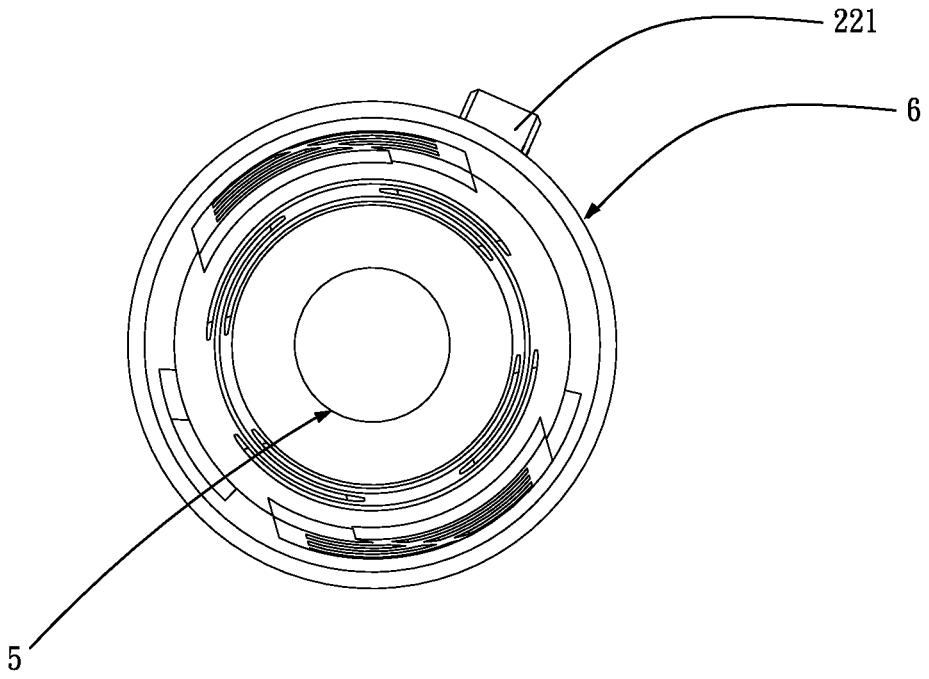
FIG. 9A is a left lateral view of the cable connector of the present invention, a conventional socket, and the caulking portion-equipped socket holder after the assembly process according to the first embodiment of the present invention.
Figure 9B:
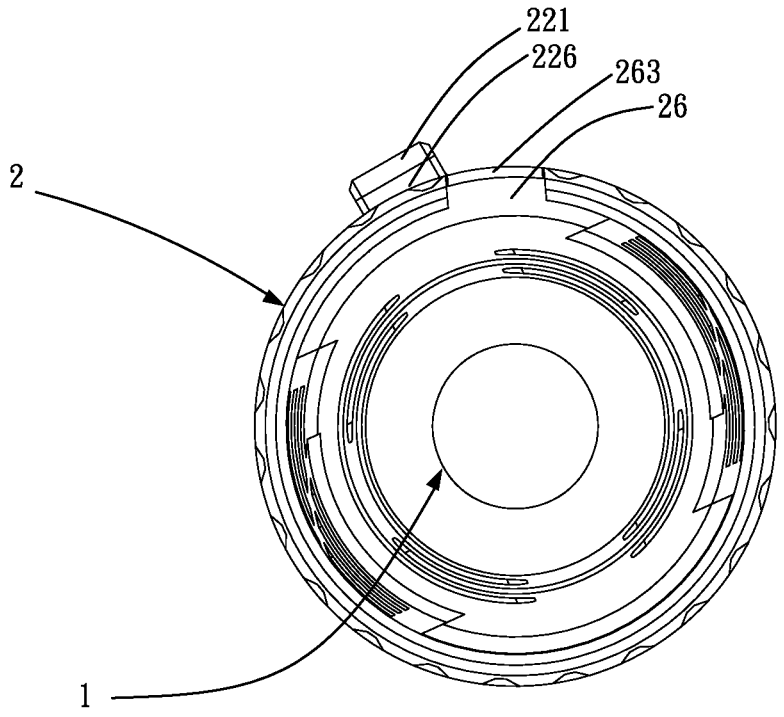
FIG. 9B is a right lateral view of the cable connector of the present invention, a conventional socket, and the caulking portion-equipped socket holder after the assembly process according to the first embodiment of the present invention.
Figure 10:
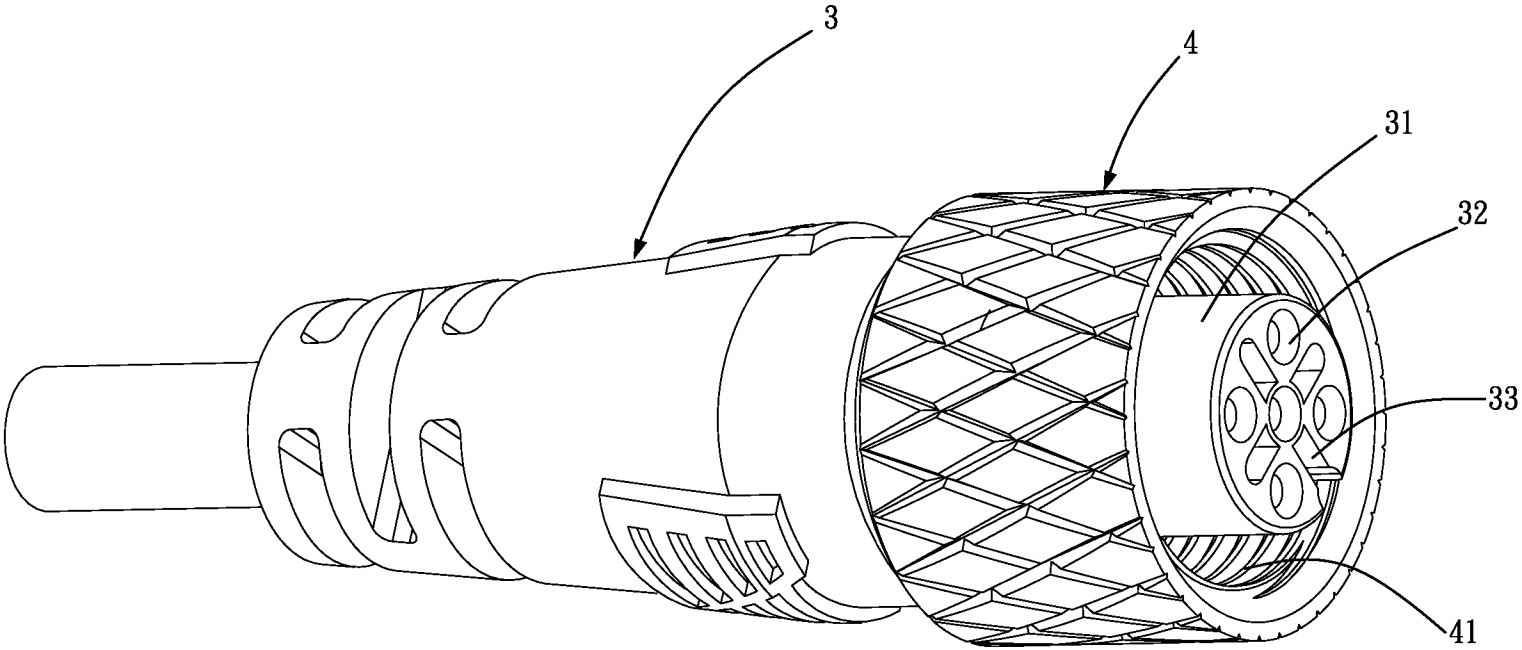
FIG. 10 (PRIOR ART) is a perspective view of a conventional socket.
Figure 11:
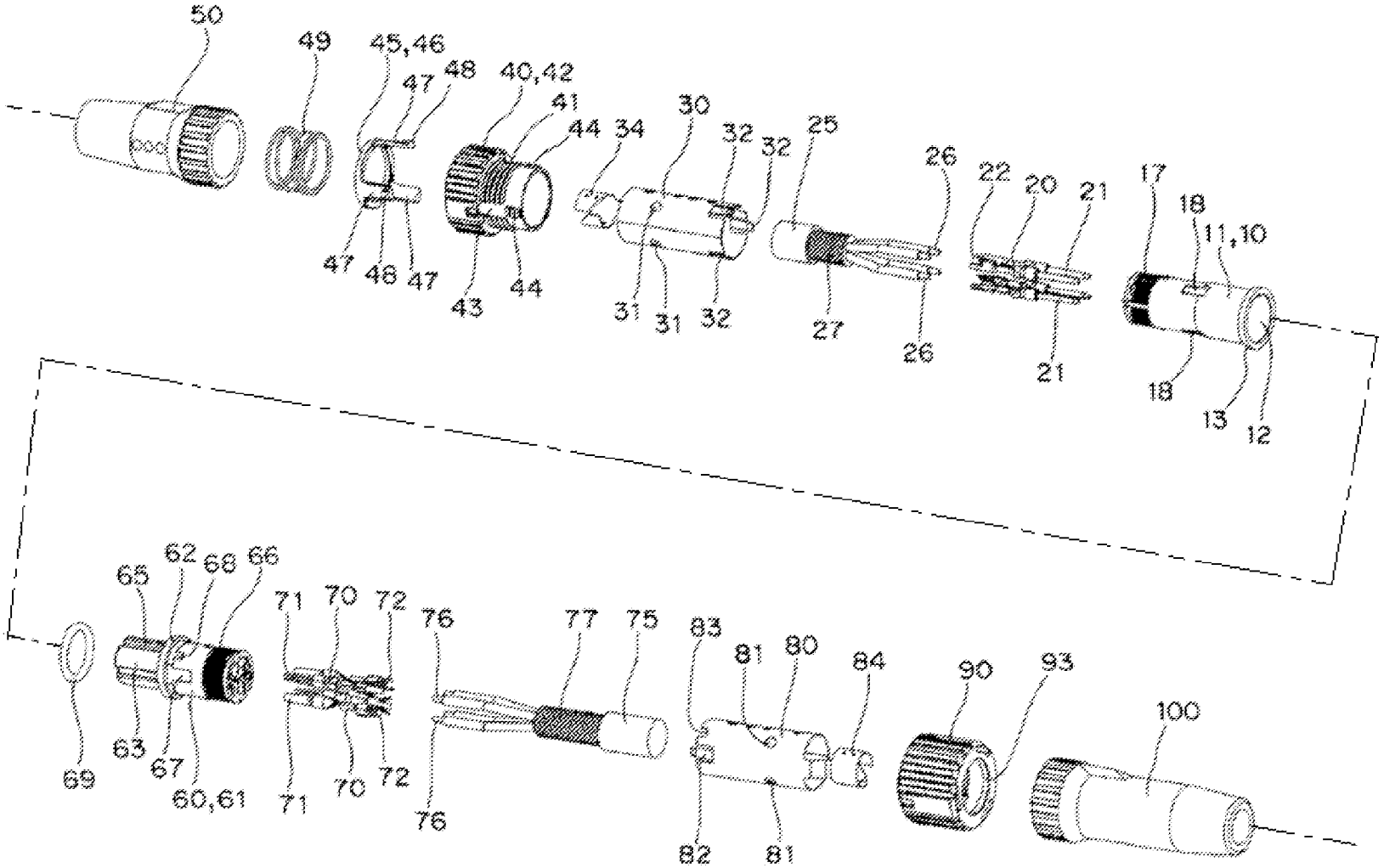
FIG. 11 (PRIOR ART) is an exploded view of a conventional cable connector.

Referring to FIGS. 9A, 9B, there are shown left and right lateral views of the cable connector of the present invention, a conventional socket, and the caulking portion-equipped socket holder after the assembly process according to the first embodiment of the present invention. As shown in the diagrams, to couple the cable connector with a switching structure to the socket 5 and the socket holder 6 equipped with a caulking portion, the user pushes the lever 221 rightward (viewed from the end of the socket holder 6 equipped with a caulking portion,) such that the at least a leaf spring 222 moves to one side within the second slot 212, wherein the protuberance 25 is present on the one side within the second slot 212 (as shown in FIG. 6A,) and the at least a leaf spring 222 is positioned above the protuberance 25. The switch ring 22 is fixed to the inner cavity of the plug holder 2 by means of the fastening nut 26. The lever 221 is disposed in the first slot 211 (as shown in FIG. 7A.) The bend portion 226 at the rear end of the lever 221 abuts against the grip portion 21 of the plug holder 2.

As mentioned above, the bump 224 at the front end of the at least a leaf spring 222 abuts against the snap-engagement surface 621 of the caulking portion 62 (as shown in FIG. 8A). Conversely, to withdraw the at least a leaf spring 222 from the snap-engagement surface 621, the user only needs to rotate the socket holder 6 equipped with a caulking portion anti-clockwise until the at least a leaf spring 222 moves to abut against the caulking portion 62, and then the user gives a pull along the recessed portion 61 to thereby disconnect the plug holder 2 from the socket holder 6. Accordingly, the objectives of the present invention, namely preventing disconnection of the cable connector, and rendering it easy to assemble and disassemble the cable connector, are achieved.

The cable connector with a switching structure according to the first and second embodiments of the present invention is described above. The cable connector with a switching structure according to the third and fourth embodiments of the present invention is described below.

In the third embodiment of the present invention, a plug with a switching structure comprises a plug 1 and a plug holder 2. The plug 1 has a plug rubber core 11. The plug rubber core 11 has pin terminals 12 and a rib 13. The plug holder 2 has a grip portion 21 with ridges and a switching structure disposed around the grip portion 21. The switching structure comprises a switch ring 22 and a fastening nut 26. The switch ring 22 and the fastening nut 26 are formed integrally as a unitary structure. The plug holder 2 is disposed around the surface of the plug 1. The plug holder 2 is coupled to the socket holders 4, 6 of different types by means of the switch ring 22.

In the fourth embodiment of the present invention, a plug with a switching structure comprises a plug 1 and a plug holder 2. The plug 1 has a plug rubber core 11. The plug rubber core 11 has pin terminals 12 and a rib 13. The plug holder 2 has a grip portion 21 with ridges and a switch ring 22 disposed around the grip portion 21. The plug holder 2 is disposed around the surface of the plug 1. The plug holder 2 is coupled to the socket holders 4, 6 of different types by means of the switch ring 22.

In conclusion, a cable connector with a switching structure provided according to the present invention fulfills the objectives thereof, as the cable connector with a switching structure is hermetically sealed, fixed in place, prevented from loosening, easy to connect and assemble, convenient to change, repair, and disassemble, easy to operate, and for use in engaging with two different types of M12 sockets.

The present invention is disclosed above by preferred embodiments. However, persons skilled in the art should understand that the preferred embodiments are illustrative of the present invention only. Hence, all equivalent design changes made to the aforesaid embodiments should fall within the scope of the present invention.

What is claimed is:

1. A cable connector with a switching structure, comprising:

a plug connector provided with a plug rubber core which is disposed with a plurality of pin terminals and a rib;

a plug holder comprising grip portion with ridges, at least a guide block disposed on a surface of the plug holder, a switch ring disposed around the grip portion, and a fastening nut abutting against the switch ring; and the switch ring disposed around the grip portion being an annular structure, the switch ring having at least a leaf spring, a lever and a ring which are formed integrally as an unitary structure; and a front end of the leaf spring of the switch ring having a bump, a rear end of the lever of the switch ring having a bend portion; and a nut circumferential portion of the fastening nut having at least a first engaging block, and an outer circumferential surface of the fastening nut having a protuberance;

wherein the plug holder is disposed around a surface of the plug connector, and the plug holder is capable of being coupled to different types of socket holders by means of the switch ring.

2. The cable connector with a switching structure according to claim 1, wherein the leaf spring of the switch ring is capable of being disposed on an outer circumferential side or an inner circumferential side of the ring.

3. The cable connector with a switching structure according to claim 1, wherein an upper surface of the grip portion of the plug holder has a first slot adapted to receive the lever, a front end of the grip portion of the plug holder has at least a second slot to accommodate the leaf spring of the switch ring, the second slot extending from the front end of the grip portion to a screw portion of the plug holder to couple the leaf spring, the lever, the ring and the plug holder, and at least a second engaging block disposed on an inner wall of the plug holder and engaged with the first engaging block.

4. The cable connector with switching structure according to claim 3, wherein a protuberance is disposed at the second slot of the plug holder.

5. The cable connector with switching structure according to claim 1, wherein at least a guide block is capable of being disposed on a surface of the plug holder and coming in form of either a convex block or a concave block.

* * * * *